US005708918A

United States Patent [19]

Okuno et al.

[11] Patent Number: 5,708,918

[45] Date of Patent: Jan. 13, 1998

[54] IMAGE FORMATION APPARATUS THAT CAN MAINTAIN APPROPRIATELY TONER DENSITY IN DEVELOPING DEVICE

[75] Inventors: Yukihiko Okuno, Toyokawa; Masaki Tanaka, Toyohashi; Naoyoshi Kinoshita; Atsushi Kawai, both of Aichi-ken; Toshifumi Watanabe, Toyohashi, all of Japan

[73] Assignee: Minolta Co., Ltd., Osaka, Japan

[21] Appl. No.: 727,319

[22] Filed: Oct. 8, 1996

[30] Foreign Application Priority Data

Oct. 11, 1995 [JP] Japan ..... 7-262702

[51] Int. Cl.[6] ..... G03G 15/10; G03G 15/01

[52] U.S. Cl. ..... 399/61; 399/63; 399/64; 399/224

[58] Field of Search ..... 399/29, 30, 61, 399/62, 64, 53, 258, 49, 46, 223, 259, 54, 58, 59, 63, 224

[56] References Cited

U.S. PATENT DOCUMENTS

| | | | |
|---|---|---|---|
| 5,315,352 | 5/1994 | Nakane et al. | 399/49 |
| 5,557,394 | 9/1996 | Haneda et al. | 399/46 X |

FOREIGN PATENT DOCUMENTS

| | | |
|---|---|---|
| 57-119363 | 7/1982 | Japan . |
| 59-7383 | 1/1984 | Japan . |
| 60-146256 | 8/1985 | Japan . |
| 4-19768 | 1/1992 | Japan . |
| 5-27597 | 2/1993 | Japan . |
| 5-27598 | 2/1993 | Japan . |
| 5-113723 | 5/1993 | Japan . |

*Primary Examiner*—Shuk Lee

*Attorney, Agent, or Firm*—Burns, Doane, Swecker & Mathis, LLP

[57] ABSTRACT

An image formation apparatus for forming a full color image in the four colors of cyan, magenta, yellow and black has a optical ATDC sensor attached in a cyan developing device to control the toner density under optical ATDC. A black developing device has the toner density controlled by AIDC. A standard develop efficiency ηSTD of the cyan developing device obtained as a result of the AIDC is compared with a develop efficiency η of black toner. The toner supply amount of the black developing device is determined according to the comparison result to supply the toner. Thus, an image formation apparatus is provided that can detect at favorable accuracy the toner density of a developing device incorporating a developer of which the toner density cannot be detected using optical ATDC to supply a required amount of toner.

21 Claims, 18 Drawing Sheets

IMAGE FORMATION APPARATUS THAT CAN MAINTAIN APPROPRIATELY TONER DENSITY IN DEVELOPING DEVICE

BACKGROUND OF THE INVENTION

1. Field of the Invention

The present invention relates to electrophotographic image formation apparatuses, and more particularly, to an image formation apparatus including a plurality of developing devices incorporating dual component developer.

2. Description of the Related Art

In a conventional electrophotographic image formation apparatus, dual component developer including magnetic carrier and toner is used to develop an electrostatic latent image formed on a photoreceptor to provide an image. In using dual component developer, only the toner therein is consumed as an image is formed, resulting in reduction in the toner density of the developer. In an image formation apparatus according to electrophotography, the toner density must be detected to supply toner if the detected toner density is lower than a predetermined reference value.

A conventional method of directing light to dual component developer to detect the toner density in a developing device according to the intensity of reflected light (referred to as "optical ATDC (Automatic Toner Density Control)" hereinafter) is known as such one method of detecting the toner density.

The optical ATDC is based on the difference in light reflectance between magnetic carrier and toner. There is a merit that detection error is less likely to occur even when the volume of the developer is altered caused by variation in the absolute humidity or temperature of the environment, or when the electrostatic property of the developer is altered as a result of repetitive usage.

However, there was a problem in optical ATDC that the toner density cannot be detected when the spectral reflectance of the toner and the magnetic carrier is analogous to each other. For example, if carbon black is added to improve the blackness of the black toner, the toner density of this black toner cannot be detected by optical ATDC. This is because the spectral reflectance of carbon black is similar to that of the magnetic carrier in such a black toner. It is necessary to detect the toner density by a method other than optical ATDC when a toner added with carbon black is used.

However, detection by a method other than optical ATDC imposes the problem that detection error occurs due to change in the volume and electrostatic property of the developer. If the toner density cannot be detected accurately, toner will not be supplied even when the actual toner density in the developing device is lower than a predetermined reference toner density, or toner will be unnecessarily supplied even when the toner density is appropriate. The toner density in the developing device will not be maintained properly in such cases.

SUMMARY OF THE INVENTION

An object of the present invention is to provide an image formation apparatus that can maintain the toner density in a developing device appropriately even when spectral reflectance of toner and magnetic carrier is analogous.

Another object of the present invention is to provide an image formation apparatus that can detect at high accuracy the toner density in a developing device incorporating a developer that cannot have the toner density detected using optical ATDC for supplying a required amount of toner.

The above objects of the present invention can be achieved by an image formation apparatus including a plurality of developing devices for developing an electrostatic latent image formed on a photoreceptor using dual component developer consisting of toner and magnetic carrier, as set forth in the following. According to an aspect of the present invention, an image formation apparatus includes a first developing device incorporating a first developer whose spectral reflectance of toner and magnetic carrier is not analogous, a second developing device incorporating a second developer whose spectral reflectance of toner and magnetic carrier is analogous, a toner density detector provided at the first developing device to direct light to the first developer for detecting the toner density of the first developing device according to the intensity of reflected light of the directed light, a first supplier for supplying toner to the first developing device according to the toner density detected by the toner density detector, a parameter detector for detecting a parameter that changes according to variation in the toner density of the first and second developing devices, a toner supply amount determinator for determining a toner supply amount of the second developing device according to parameters of the first and second developing devices detected by the parameter detector, and a second toner supplier for supplying toner to the second developing device according to the toner supply amount determined by the toner supply amount determinator.

Parameters that change corresponding to variation in the toner density of the first and second developing devices are detected. Therefore, the relationship between the actual toner density or actual toner supply amount and the detected parameter can be identified. It is presumed that the first and second developer vary over time substantially identically under substantially the same environment. According to this presumption, the toner supply amount of the second developing device is determined from the relationship between the actual toner density or actual toner supply amount and the detected parameter of the first developing device, and from the parameter of the second developing device. Toner is supplied to the second developing device according to this determined toner supply amount. Thus, toner can be supplied appropriately even when the second developer of the second developing device is one that is not applicable to optical ATDC. The toner density can be maintained appropriately.

According to another aspect of the present invention, an image formation apparatus forms an electrostatic latent image on a photoreceptor according to digital image signals, and includes a plurality of developing devices for developing the electrostatic latent image using dual component developer consisting of toner and magnetic carrier. The image formation apparatus of the present aspect includes a first developing device incorporating a first developer whose spectral reflectance of toner and magnetic carrier is not analogous, a second developer device incorporating a second developing whose spectral reflectance of toner and magnetic carrier is analogous, a toner density detector provided at the first developing device to direct light to the first developer for detecting the toner density of the first developing device according to intensity of reflected light out of the directed light, a first toner supplier for supplying toner to the first developing device according to the toner density detected by the toner density detector, a toner consumption amount estimator for estimating the amount of toner consumption of the first and second developing devices according to density information included in the image signal, a toner supply amount determinator for determining the toner supply amount of the second developing device according to the amount of toner consumption of the first and second developing devices estimated by the toner consumption amount estimator and the amount of toner supplied to the first developing device by the first toner supplier, and a second toner supplier for supplying toner to the second developing device according to the toner supply amount determined by the toner supply amount determinator.

The amount of toner consumption of the first and second developers is estimated according to the density information included in the digital image signal. Toner is actually supplied to the first developing device by Optical ATDC. Therefore, the relationship between the amount of toner consumption estimated from the digital image signal and the actual toner supply amount for the first developer can be identified. It is presumed that the relationship between the estimated amount of toner consumption and the actual toner supply amount is substantially identical for the first and second developing solvents. According to this presumption, the toner supply amount of the second developer can be calculated by applying the estimated amount of toner of the second developer to the relationship between the toner consumption amount and toner supply amount of the first developer. By supplying toner to the second developing device according to the calculated toner supply amount, the toner density can be maintained appropriately in the second developing device.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

[Structure of Copier]

Figure 1:
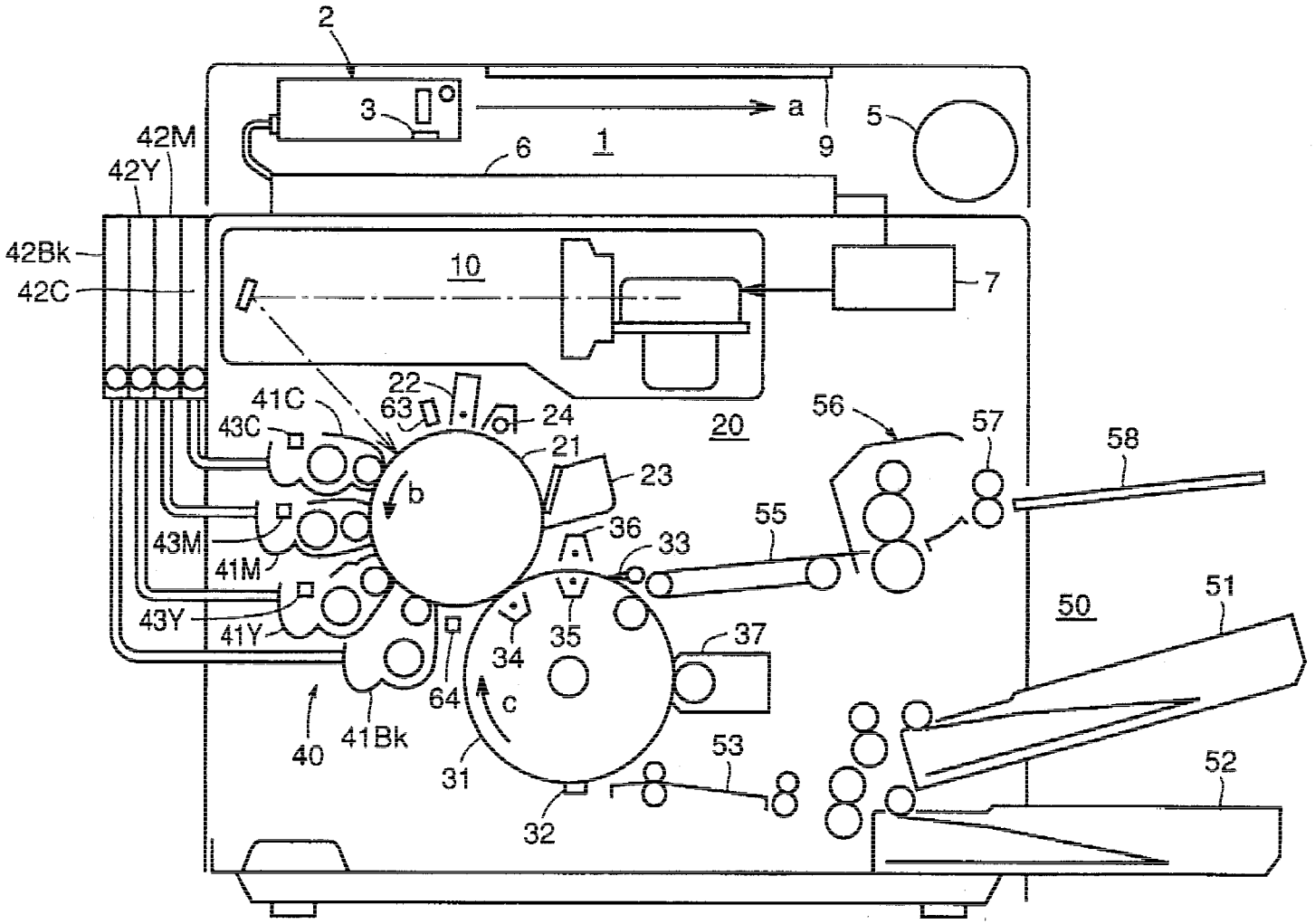
FIG. 1 is a schematic diagram of a structure of a full color copier according to a first embodiment.

Referring to FIG. 1, a digital type full color copier includes an image reader unit 1, a laser scan unit 10, a full color image formation unit 20, and a sheet feed unit 50.

Image reader unit 1 includes a scanner 2 for reading an image of an original set on platen glass 9, and an image signal processor 6 for converting and processing the readout image into image data. Scanner 2 is of a well known type including a contact color image sensor (CCD) 3 driven by a motor 5 to move in the direction of arrow a to scan an original. CCD 3 reads out one line at a time the three primary colors of R (red), G (green), and B (blue) from the image of the original to provide the readout signals to image signal processor 6. Image signal processor 6 converts the signals of the three primary colors from CCD 3 into image data of 8 bits corresponding to the four colors of Y (yellow), M (magenta), C (cyan), and Bk (black) to transfer the converted image data to a buffer memory 7 for synchronization.

Laser scan unit 10 is of a well known type for modulating a laser beam emitted from a laser diode to form an electrostatic latent image on a photoreceptor drum 21 rotating in the direction of arrow b. Laser scan unit 10 carries out gradation correction according to the gradation characteristic of the photoreceptor on the print data applied from buffer memory 7, which is D/A converted. A laser diode drive signal is generated, whereby the laser diode is lit according to this drive signal.

Full color image formation unit 20 is formed mainly of photoreceptor drum 21 and a transfer drum 31. A corona charger 22, a developing unit 40, a cleaner 23 for cleaning residue toner, and an eraser lamp 24 for erasing residue charge are provided around photoreceptor drum 21. Developing unit 40 includes developing devices 41C, 41M, 41Y, and 41Bk in which a developer including the toners of cyan, magenta, yellow and black, respectively, are accommodated from the top stage. A corresponding developing device is driven as an electrostatic latent image of each color is formed on photoreceptor drum 21. Optical ATDC sensors 43C, 43M and 43Y for supplying respective color toners are provided in developing devices 41C, 41M and 41Y, respectively, incorporating color toners. The toners of cyan, magenta, yellow and black are accommodated in hoppers 42C, 42M, 42Y and 42Bk, respectively, to be supplied to developing devices 41C, 41M, 41Y and 41Bk, respectively, under toner supply control that will be described afterwards. Furthermore, a potential sensor 63 for detecting the surface potential of photoreceptor drum 21, and an AIDC (Automatic Image Density Control) sensor 64 for detecting the image density of a test toner image are provided around photoreceptor drum 21.

Transfer drum 31 is provided in a rotatably driven manner in the direction of arrow c at the same speed of photoreceptor drum 21. A toner image is transferred onto a sheet wrapped around the surface of transfer drum 31. Transfer drum 31 includes a claw member 32 for chucking the leading edge of a sheet, and a claw member 33 for releasing the sheet. A transfer charger 34 is provided in transfer drum 31 at a position opposite to photoreceptor drum 21. Two dischargers 35 and 36 opposite to each other so as to sandwich transfer drum 31 are arranged at a position remote from transfer charger 34 by a predetermined distance in the rotation direction. A cleaner 37 of residue toner is provided outside transfer drum 31 at a position remote from dischargers 35 and 36 by a predetermined distance in the rotating direction.

Sheet feed unit 50 includes two stages of sheet feed trays 51 and 52. A sheet is fed one by one from either tray 51 or 52 selected by the operator. The fed sheet is conveyed on a transport path 53 to be wrapped around transfer drum 31.

In forming a full color image, toner images of cyan, magenta, yellow and black are sequentially formed on photoreceptor drum 21. Respective toner images are sequentially transferred and overlaid on the sheet wrapped around transfer drum 31 by discharge of transfer charger 34. When the images of four colors are combined on the sheet, claw member 32 releases the sheet chucking, and claw member 33 operates to remove the sheet from transfer drum 31. The released sheet is fed to a fixer device 54 by transport belt 55. Here, the toner is fixed. Then, the sheet is discharged onto a tray 58 from a discharge roller 57.

[Copier Control]

Figure 2:
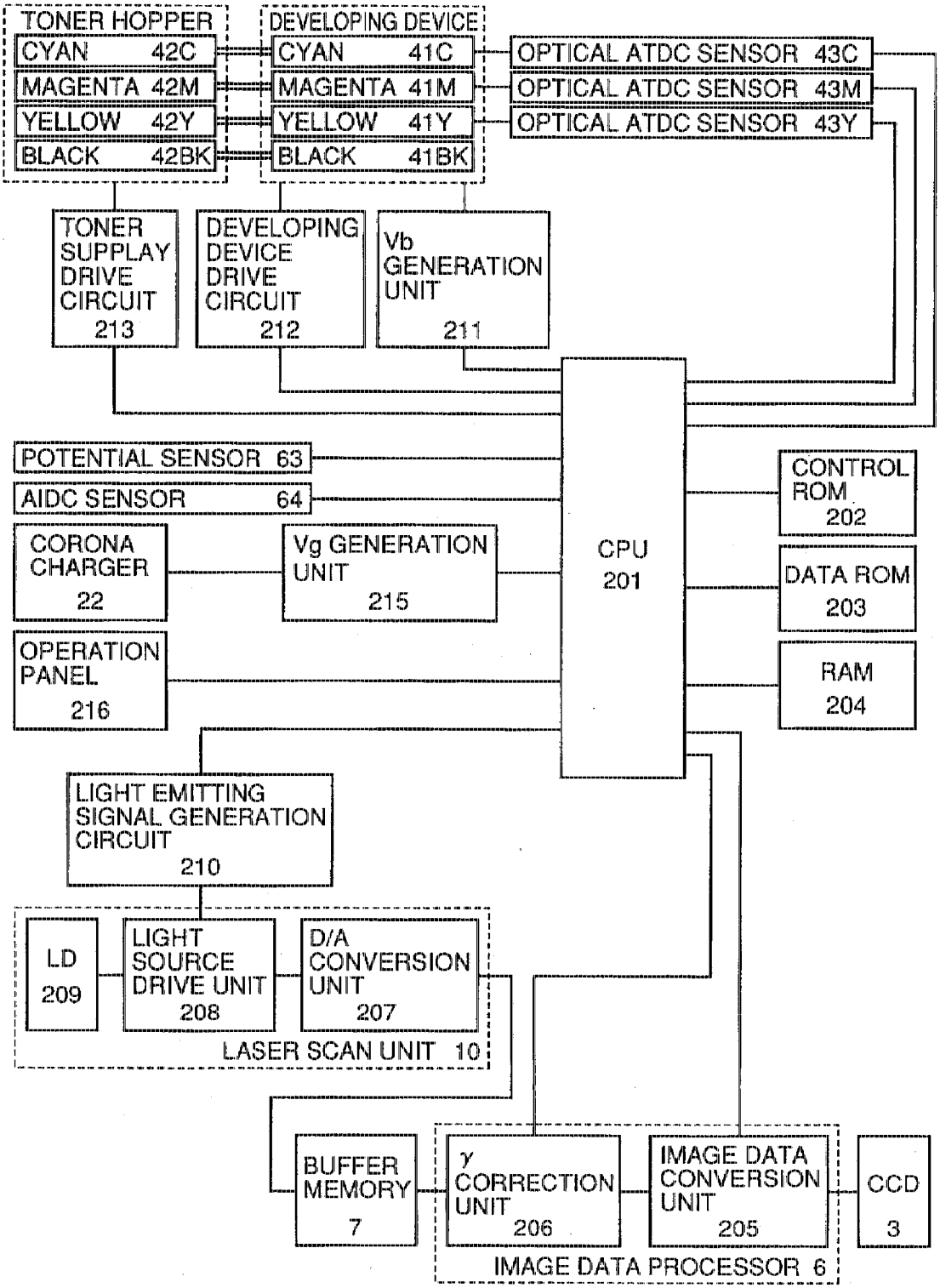
FIG. 2 is a block diagram of a control circuit of the full color copier of the first embodiment.

FIG. 2 is a block diagram of the printer control system of the copier of the present invention. The printer control system is mainly constituted by a printer central control unit (referred simply as CPU hereinafter) 201. A control ROM 202 in which a program for control is stored, a data ROM 203 in which various data are stored, and a RAM 204 are connected to CPU 201.

The image read out by CCD3 is converted into image data by image data conversion unit 205 of image signal processor 6. The converted image data is provided to a γ correction unit 206. The γ-corrected image data of γ correction unit 206 is transferred to buffer memory 7. When a light emitting timing signal is provided from a light emitting signal generation circuit 210, the image data is converted into an analog signal by a D/A converter 207 of image reader unit 10. The laser diode is controlled by light source drive unit 208 according to the analog signal such that the laser beam is turned on/off. In the full color copier of the present embodiment, the gradation of the image is represented by modulating the intensity of the laser beam.

Developing devices 41C, 41M, 41Y and 41Bk are driven by a developing device drive circuit 213 to which a control signal from CPU 201 is applied. The outputs of optical ATDC sensors 43C, 43M and 43Y are applied to CPU 201. CPU 201 detects the toner density of cyan, magenta, and yellow developing devices 41C, 41M and 41Y from the output values of the respective optical ATDC sensors to determine the toner supply amount towards each developing device according to the detected toner density. CPU 201 provides a control signal corresponding to the toner supply amount to a toner supply drive device 213. In toner supply drive device 213, toner is supplied to developing devices 41C, 41M and 41Y from hoppers 42C, 42M and 42Y in which the toners of cyan, magenta, and yellow are accommodated, respectively, if the toner density is lower than a predetermined value according to the control signal from CPU 201. The toner density control of developing device Bk in which a optical ATDC sensor is not attached will be described afterwards.

Furthermore, the output values from potential sensor 63 and AIDC sensor 64 are applied to CPU 201. In response, CPU 201 provides control signals to a develop bias Vb generation unit 211 and a grid potential Vg generation unit 215 to control the image density. Various signals from an operation panel 216 are also applied to CPU 201.

[Image Density Control (referred to as AIDC hereinafter)]

In the full color copier of the first embodiment, charge potential VO of photoreceptor drum 21 before exposure is substantially equal to grid voltage Vg. Therefore, charge potential VO can be controlled by modifying grid voltage Vg. Charge potential VO is measured by a potential sensor 63 provided facing the photoreceptor.

The image formation apparatus of the first embodiment employs reversal development wherein toner is attached to an image portion that attains a low potential Vi (substantially 0V) by being exposed by a laser beam emitted from laser scan unit 50. When the charge potential of photoreceptor drum 21 takes a minus value, the charge polarity of the toner is also minus. A develop bias voltage Vb of a minus polarity is applied to the develop sleeve of the developing device. In reversal development, toner is attached to an area where the potential is lower than this develop bias voltage Vb.

Prior to the description of AIDC, it is defined that the potential difference between the area equal to develop bias voltage Vb and the area lower than develop bias voltage Vb by exposure is develop potential difference ΔV (V), and the amount of toner attachment on the surface of the photoreceptor drum per 100V of develop potential difference is develop efficiency η ($mg/cm^2.100V$).

In AIDC, first a test toner image is formed on photoreceptor drum 21 under the condition of predetermined grid voltage Vg, develop bias voltage Vb and an exposure amount. The diffused reflected light of the test toner image is detected by AIDC sensor 64 to obtain an image density of the test toner image. The detected image density is applied to CPU 201. Develop efficiency η is calculated according to the data stored in data ROM 203. By altering grid voltage Vg and develop bias voltage Vb corresponding to the obtained develop efficiency η so that the image attains the maximum density level, the maximum image density corresponding to the environmental conditions can be maintained.

The grid voltage Vg and the develop bias voltage Vg by which the maximum image density level is obtained are set as a pair, and stored in data ROM 203 in a table format. Since variation in grid voltage Vg and develop bias voltage Vb causes change in the gradation characteristics of the photoreceptor, γ correction data according to respective grid voltage Vg and develop bias values Vb is necessary. The γ correction data corresponding to grid voltage Vg and develop bias Vb is preset and stored in data ROM 203 in a table format. The above-described AIDC is carried out for the four colors of cyan, magenta, yellow and black.

The following Table 1 shows an example of an image density table. Table 1 shows develop potential difference ΔV, develop bias value Vb to grid voltage Vg, and γ correction table with respect to the develop efficiency η calculated from the cyan toner attachment amount.

TABLE 1

Image Density Correction Table

| Develop Efficiency η (mg/cm³/100 V) | ΔV | Vg/Vb | γ Correction Table Number |
|---|---|---|---|
| 0.696 | 115 | 480/235 | γ1 |
| 0.615 | 130 | 470/250 | γ2 |
| 0.500 | 160 | 500/280 | γ3 |
| 0.421 | 190 | 540/315 | γ4 |
| 0.348 | 230 | 580/335 | γ5 |
| 0.296 | 270 | 630/400 | γ6 |
| 0.258 | 310 | 670/440 | γ7 |
| 0.229 | 350 | 730/490 | γ8 |
| 0.205 | 390 | 780/530 | γ9 |
| 0.182 | 440 | 840/585 | γ10 |
| 0.163 | 490 | 890/635 | γ11 |
| 0.148 | 540 | 960/690 | γ12 |

According to AIDC, develop efficiency η is obtained, and grid voltage Vg, develop bias value Vb, and γ correction table providing the maximum image density at the time point of AIDC is determined from Table 1. Accordingly, CPU 201 provides respective control signals to Vb generation unit 211, Vg generation unit 215, and γ correction unit 206 to set develop bias value Vb, grid voltage Vg, and γ correction table. By forming an image thereafter according to the set develop bias value Vb, grid voltage Vg and γ correction table, an image of the proper image density can always be output.

The AIDC is not limited to the control of setting all the parameters of develop bias value Vb, grid voltage Vg, and γ correction table, and the parameters to be set may be combined arbitrarily. Also, the light emitting intensity of laser diode 209 may be controlled by providing a control signal from CPU 201 to light emitting signal control circuit 216 to set the amount of exposure of the photoreceptor.

[Toner Density Control]

In the full color copier of the first embodiment, the toner supply amount of cyan, magenta, and yellow are determined according to the toner density detected by the optical ATDC sensors provided in cyan, magenta, and yellow developing devices 41C, 41Y, and 41M. In black developing device 41Bk, control is carried out by adding correction according to information under ATDC by the optical ATDC sensor provided in developing device 41C to the toner density obtained from develop efficiency η. Since optical ATDC is well known, the toner density control of black developing device 41Bk will be described hereinafter.

Figure 3:
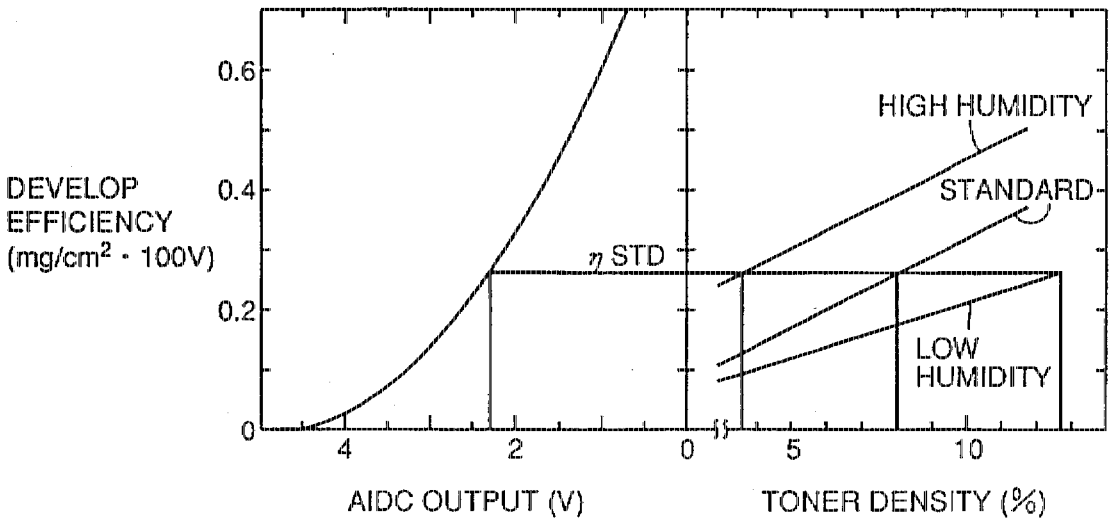
FIG. 3 is a graph showing the relationship between develop efficiency and toner density, and between develop efficiency and the output of an AIDC sensor.

Referring to FIG. 3, the relationship between develop efficiency η and the toner density of each case of a high temperature-high humidity environment (30° C., 15 g/m³), standard environment (20° C., 6 g/m³), and low temperature-low humidity environment (10° C., 3 g/m³) is provided at the right side, and the relationship between the output voltage of AIDC sensor 64 and develop efficiency η is illustrated at the left side. Here, the indicated humidity is the absolute humidity. It is defined that the absolute humidity is the amount of vapor included in the air of one cubic meter in volume in the unit of g/m³.

First, toner supply control of the black developer by AIDC will be described with reference to FIG. 3.

In data ROM 203 are stored a table indicating the relationship between the output value of AIDC sensor 64 and develop efficiency η (the left side graph of FIG. 3, a table indicating the relationship between develop efficiency η and toner density in a standard environment (the straight line of the right side graph indicating the standard environment of FIG. 3), and the standard develop efficiency ηSTD with respect with an appropriate toner density (8% in the first embodiment). Upon implementation of AIDC, the output voltage of AIDC sensor 64 is provided to CPU 201, whereby develop efficiency η is calculated. This develop efficiency η is compared with the standard develop efficiency ηSTD stored in data ROM 203. If develop efficiency η is greater, determination is made that toner is excessively supplied and the toner charge amount is low. Therefore, toner is not supplied. If develop efficiency η is smaller, determination is made that the toner is insufficient and the toner charge amount is increased. Therefore, toner is supplied (refer to the right side graph of FIG. 3).

Thus, the toner density in the developer is detected by calculating develop efficiency η under constant image formation conditions in AIDC. The toner density in the developing device is maintained at a constant value as long as variation in develop efficiency η is caused only by variation in the toner density in the developing device. However, it is known that develop efficiency η varies according to change in the image formation conditions in an electrophotographic image formation apparatus.

Figure 4:
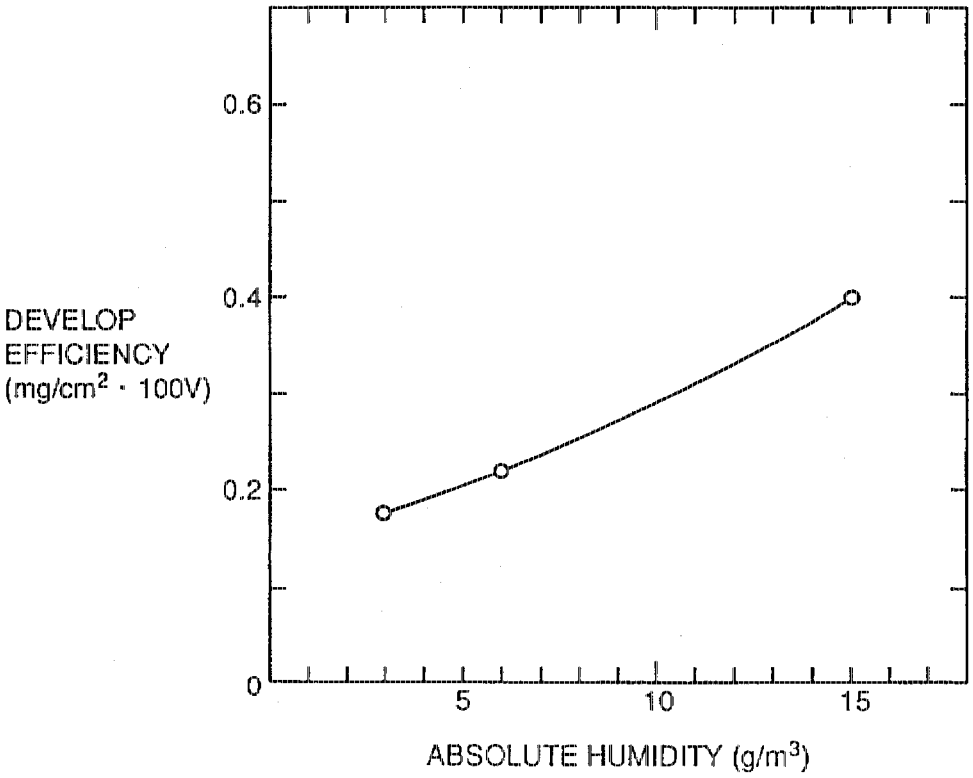
FIG. 4 is a graph showing the relationship between develop efficiency and absolute humidity.

Referring to the graph of FIG. 4 showing the relationship of develop efficiency η and absolute humidity, it is apparent that develop efficiency η rises even when the toner density is the same since increase in the amount of vapor in the air by a higher absolute humidity causes reduction in the charge amount of the developer. On the contrary, develop efficiency η decreases even when the toner density is identical since reduction in the amount of vapor in the air by a lower absolute humidity causes increase of the charge amount of the developer.

Figure 5:
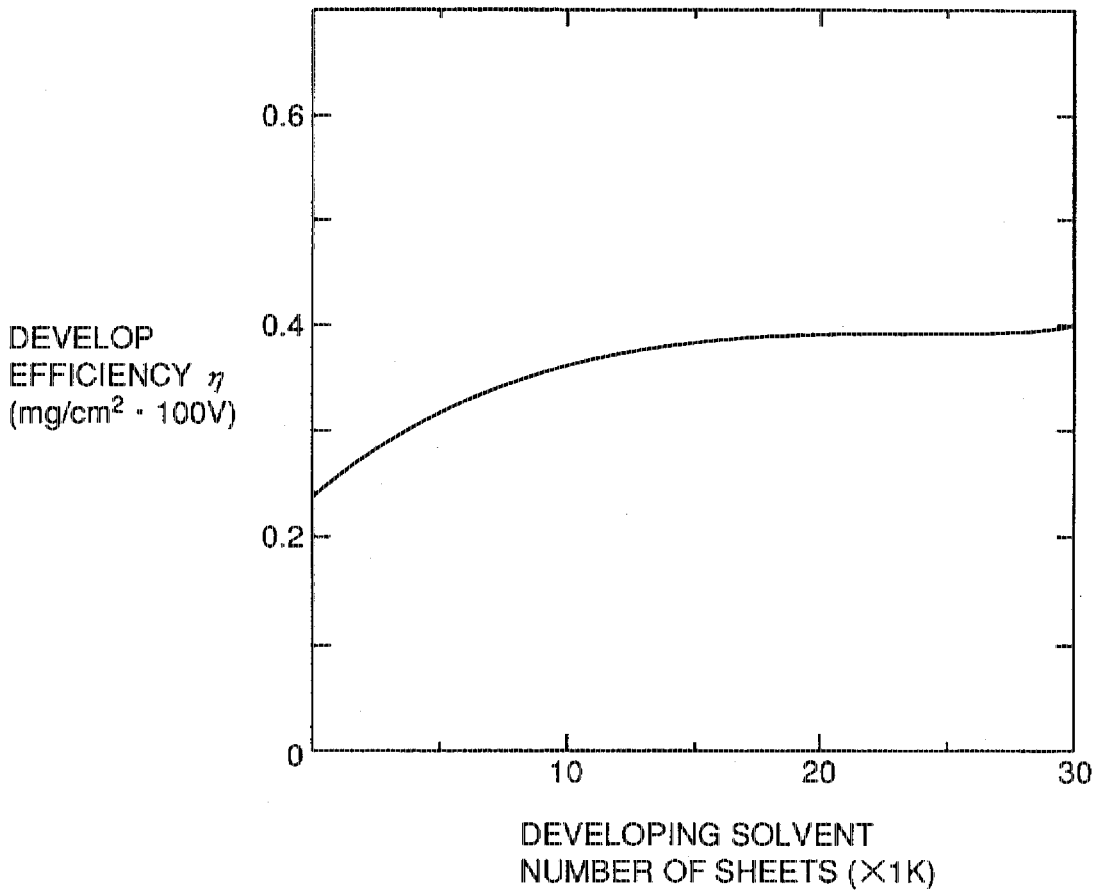
FIG. 5 is a graph showing the relationship between develop efficiency and the number of copies.

When the number of copies is increased (durability degree), the magnetic carrier is degraded due to contamination or the like on the surface of the magnetic carrier by toner. As a result, the charge characteristics vary to alter develop efficiency η. FIG. 5 is a graph showing the change in develop efficiency η when the number of copies is increased under the same condition (toner density 8%, absolute humidity 6 g/m³). Increase in the number of copies causes reduction in the charge amount of the toner due to degradation of magnetic carrier. There is a tendency for increase in develop efficiency η.

Additionally, it is known that develop efficiency η changes due to variation in the image formation conditions such as temperature change and usage status of the apparatus (resting time period of developing device, type of image, etc.).

A change in develop efficiency η results in a greater difference between the estimated toner density from the output of AIDC sensor 64 and the actual toner density. A proper toner supply amount will not be determined, so that the toner density in the developing device cannot be maintained appropriately. For example, variation in the absolute humidity causes a change in the relationship between develop efficiency η and the toner density as shown in the right side graph of FIG. 3. The toner density estimated from the standard develop efficiency ηSTD is approximately 4% at a high temperature-high humidity environment and approximately 13% at a low temperature-low humidity environment with respect to standard develop efficiency ηSTD corresponding to the toner density of 8% in the standard environment. In other words, the difference between the estimated toner density and the actual toner density becomes as great as approximately 9%, so that the toner density cannot be maintained appropriately.

If toner is supplied on the basis of only develop efficiency η, there is a disadvantage that toner may not be supplied even when lower than the proper toner density, or that toner is supplied excessively even when at a proper toner density. There is a possibility that the toner density in the developing device is not maintained appropriately. It was difficult to sufficiently control the toner density in the developing device by just obtaining the toner supply amount for the developing device according to develop efficiency η obtained by AIDC.

In a full color copier including developing devices of 4 colors, respective developing devices is used under the same environment, the same copy mode, and under the same durability degree. Therefore, the developer of cyan and the developer of black correspond to the change in the image formation conditions substantially under the same fashion even though there is a slight difference caused by the characteristic of each developer.

Figure 6:
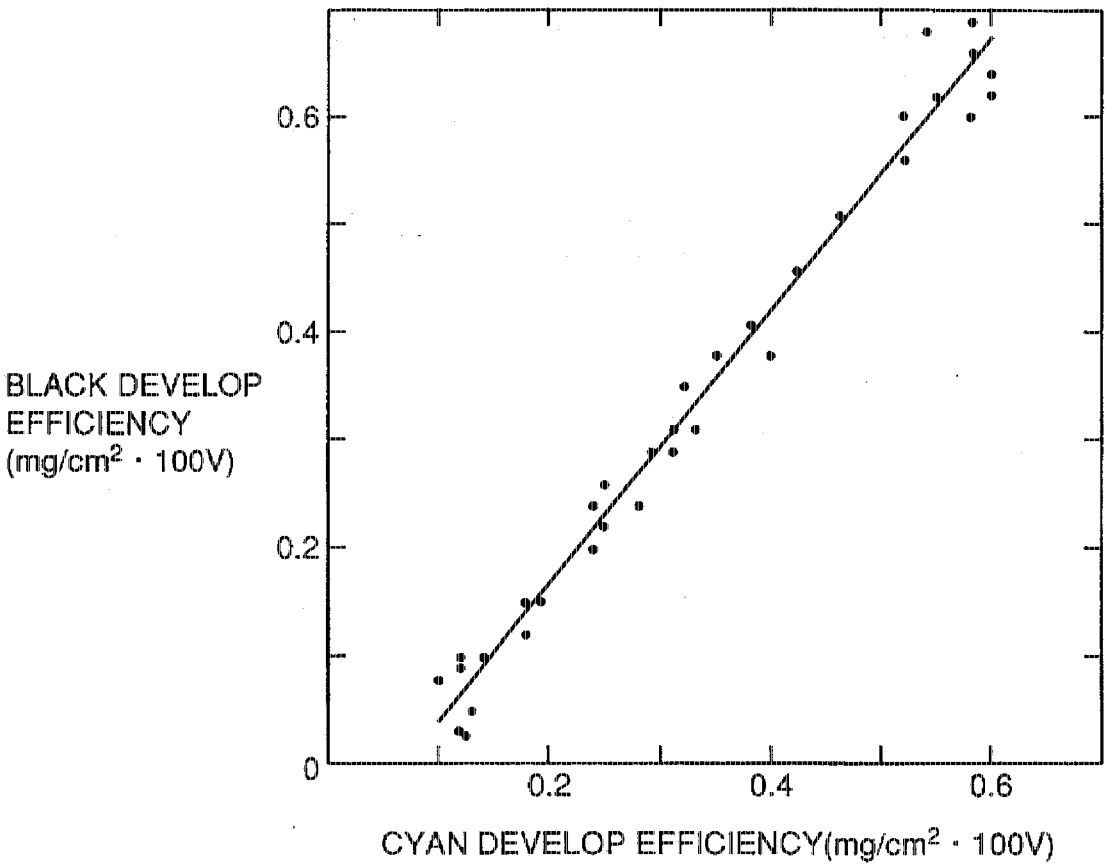
FIG. 6 is a graph showing the relationship of develop efficiency between a cyan developing device and a black developing device of the first embodiment according to experiments.

FIG. 6 is a graph showing the relationship of develop efficiency η at the toner density of 8% between cyan developing device 41C and black developing device 41Bk obtained by experiments. It is appreciated from FIG. 6 that the develop efficiency of the cyan toner and the black toner vary substantially under a similar manner. Therefore, develop efficiency of the black toner can be obtained if the develop efficiency of the cyan toner is identified.

Cyan developing device 41C has the toner density controlled by optical ATDC that does not easily generate detection error even when the environment, copy mode, durability degree, and the like changes. The toner density in developing device 41C is maintained at a constant level even if develop efficiency η thereof changes. Therefore, develop efficiency η is calculated always under a proper toner density condition for cyan toner. In other words, develop efficiency η of the cyan toner calculated by AIDC represents the proper toner density.

According to this understanding, the image formation apparatus of the first embodiment effects toner density control of a black developing device 41Bk as set forth in the following. Since the develop efficiency of the cyan toner and that of the black toner vary similarly, develop efficiency η with respect to the proper toner density of the cyan toner corresponds to the develop efficiency η for the proper toner density even for the black toner. Therefore, in supplying toner according to AIDC, develop efficiency η of the cyan toner is converted into a value of develop efficiency η of the black toner according to FIG. 6. The calculated develop efficiency η of the black toner is substituted as standard develop efficiency ηSTD. The supply amount of the black toner is determined by comparing the new standard develop efficiency ηSTD and develop efficiency η of the black toner calculated under AIDC.

In the first embodiment, develop efficiency η at the toner density of 8% of the black toner with respect to develop efficiency η of cyan toner is stored in data ROM 203 as data of 6 bits. According to the stored data, the standard develop efficiency ηSTD of the black toner is sequentially substituted by CPU 201, whereby toner density control is carried out by the AIDC sensor.

Figure 7:
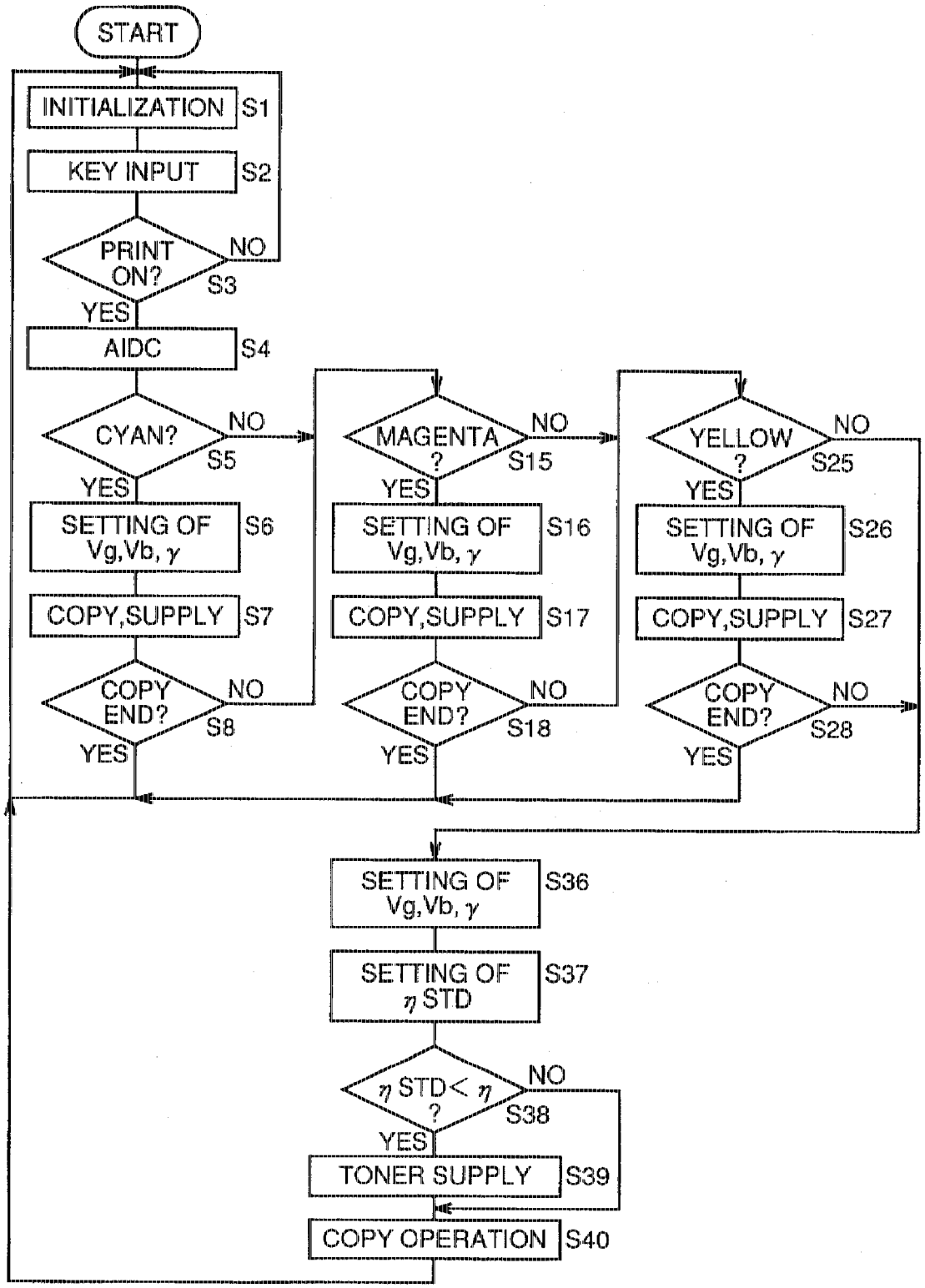
FIG. 7 is a flow chart of a toner density control of the first embodiment.

A specific toner density control will be described hereinafter with reference to the flow chart of FIG. 7.

When the power of the copier is turned on, initialization is carried out (S1). Key input is accepted (S2). In this key input step, the number of copies, the copy mode, and the like are set by the operator.

Next, determination is made whether the print switch is turned on or not (S3). If the print switch is not turned on, the control returns to the acceptance of key input (S2). If the print switch is ON, measurement of a test toner image by the AIDC sensor is carried out (S4). In the test toner image measurement by the AIDC sensor, a test tone image is formed on a photoreceptor according to the pre-determined develop potential difference ΔV, and develop efficiency η of cyan, magenta, yellow, and black is obtained.

Next, determination is made whether the operation is a cyan copy (S5). If not a cyan copy, the control proceeds to the determination of a magenta copy (S15). If a cyan copy is carried out, grid voltage Vg, develop bias Vb, γ correction table of Table 1 stored in data ROM 203 are selected and set (S6) according to develop efficiency η of the cyan developing solvent obtained at S4. Then, image formation according to electrophotography is carried out. At the same time, the toner density is adjusted for cyan developing device 41C (S7) under ATDC by optical ATDC sensor 43C. Then, determination is made whether copy and adjustment of the toner density are to be continued or not (S8). If the operation is to be continued, the control proceeds to the determination of a magenta copy (S15). When the copy operation ends, the control returns to S2.

Copy operations of magenta (S15~S18) and yellow (S25~S28) are carried out in a manner identical to that of the cyan copy.

When the copy and toner density adjustment of yellow ends, or if a copy operation of yellow is not carried out, a copy operation of black proceeds. Grid voltage Vg, develop bias Vb, and γ correction table of Table 1 stored in data ROM 203 are selected and set (S36) according to develop efficiency η of the black developer obtained at S4. Then, standard develop efficiency ηSTD of the black developer is replaced according to develop efficiency η of the cyan developer by the data in ROM 203 (S37). Develop efficiency η of the black developer measured by the test tone image measurement (S4) by the AIDC sensor of the black developer is compared with the corrected standard develop efficiency ηSTD (S38). Determination is made that the toner density is high if develop efficiency η is larger, so that toner is not supplied. Determination is made that the toner density is low if develop efficiency η is smaller, so that the toner is supplied (S39). Formation of a black image by the well-known electrophotography is carried out (S40). At the completion of the above-described operations, the control returns to acceptance of key input (S2).

Thus, black developing device 41Bk has standard develop efficiency ηSTD of black toner set according to develop efficiency η of cyan developing device 41C having the toner density controlled appropriately by optical ATDC. Therefore, an appropriate toner supply amount is determined under AIDC.

Although standard develop efficiency ηSTD of the black toner is replaced according to develop efficiency η of the cyan toner in the first embodiment, standard develop efficiency ηSTD of the black toner may be replaced according to develop efficiency η of the magenta or yellow toner. Alternatively, an optical ATDC sensor can be provided in any one of cyan, magenta, and yellow developing devices, and determine the toner supply amount for all the other developing devices under AIDC, or determine the toner supply amount of any one of the cyan, magenta, and yellow developing devices under AIDC. An arbitrary combination of optical ATDC and AIDC can be provided in determining the toner supply amount.

In the first embodiment, all the data are stored in data ROM 203 in the form of a table. However, the memory can be reduced by approximating the relationship of develop efficiency η of cyan toner and the black toner corresponding to FIG. 6 with an appropriate function to sequentially obtain develop efficiency η of the black toner from the function thereof.

Second Embodiment

[Structure and Control of Copier]

The structure of a full color copier according to a second embodiment of the present invention is substantially similar to that of the first embodiment. Only the different elements will be described hereinafter, and description of the same elements will not be repeated.

Figure 8:
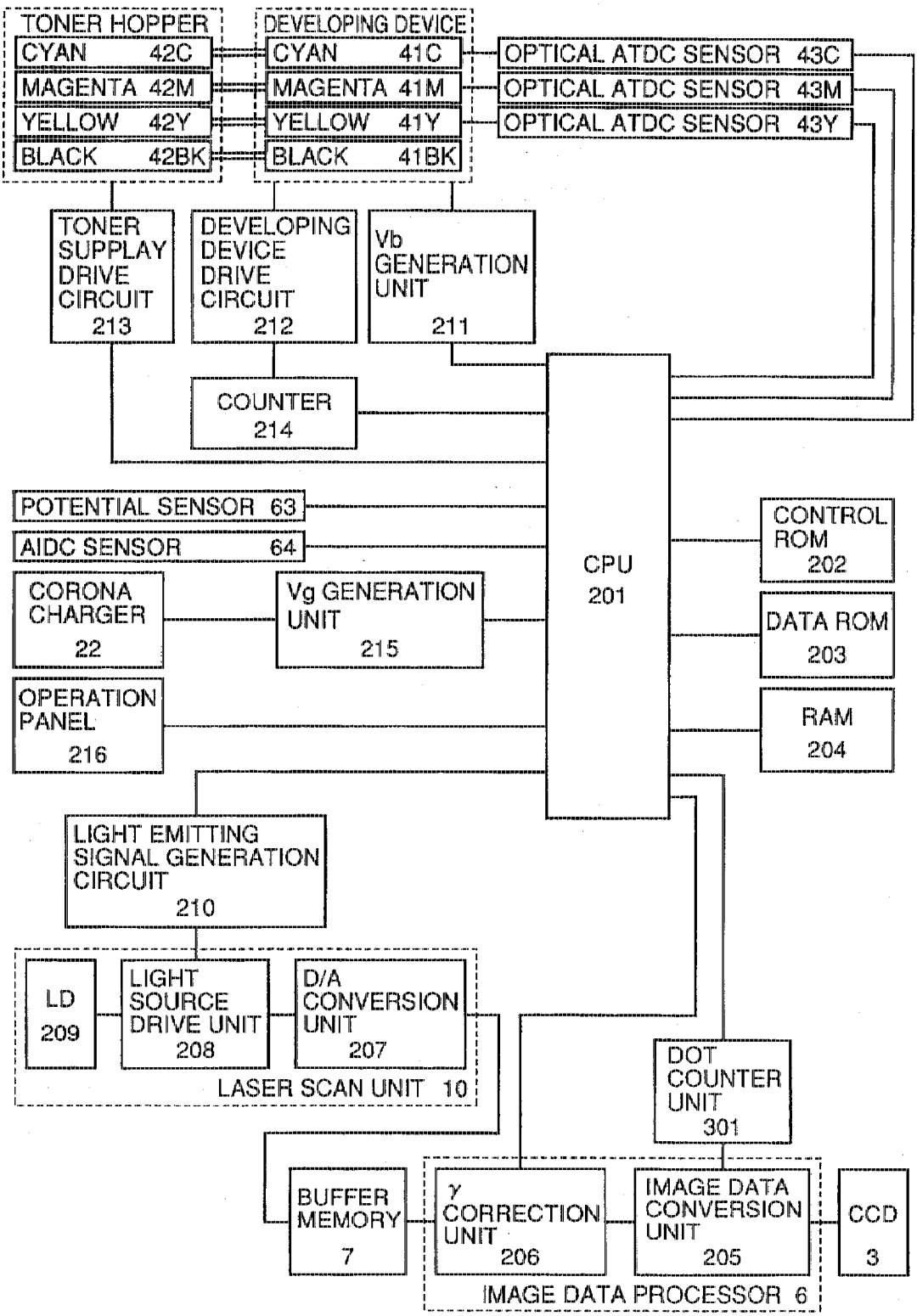
FIG. 8 is a schematic diagram of a structure of a full color copier according to a second embodiment.

Referring to the block diagram of FIG. 8, image data is provided from image data conversion unit 205 that converts an image read out by CCD3 into image data. The image data is provided to a dot counter unit 301 where the number of pixels of each gradation level corresponding to image data of one image is summed for each color of cyan, magenta, yellow, and black. The total value of the number of pixels is applied to CPU 201.

The driving number of times of developing device drive circuit 213 of each color is counted by a counter 214 connected to developing device drive circuit 213. The count value is applied to CPU 201.

[Toner Density Control]

Among the four developing devices provided in the second embodiment, cyan developing device 41*c*, magenta developing device 41*m*, and yellow developing device 41Y have the toner density controlled according to optical ATDC likewise the first embodiment. The toner density of black developing device 41Bk is controlled by adding a correction according to the actual amount of cyan toner supplied under optical ATDC provided in cyan developing device 41C to an amount of toner consumption estimated by a dot counter system. The toner density control of black developing device 41Bk will be described hereinafter.

In controlling the toner density by using a dot counter, the number of pixels of the same gradation is counted at a dot counter unit 301. The number of pixels of each gradation level of one entire image is detected. CPU 201 converts this number of pixels into the value of an amount of toner consumption using a conversion table that converts the amount of toner attachment to photoreceptor drum 21 for a predetermined gradation level, whereby the amount of toner consumption of the image is estimated. Then, an amount of toner identical to the toner supply amount is supplied to the developing device so as to maintain the toner density thereof appropriately. The following Table 2 shows an example of a conversion table for converting the amount of toner attachment onto photoreceptor drum 21 according to a predetermined level. In the second embodiment, the data of Table 2 is stored in data ROM 203.

TABLE 2

| Gradation Level (Image Density) | Amount of Toner Attachment on Photoreceptor ($mg/cm^2$) |
|---|---|
| 0 | 0.00 |
| . | . |
| . | . |
| . | . |
| 128 | 0.30 |
| . | . |
| . | . |
| . | . |
| 255 | 1.00 |

Figure 9:
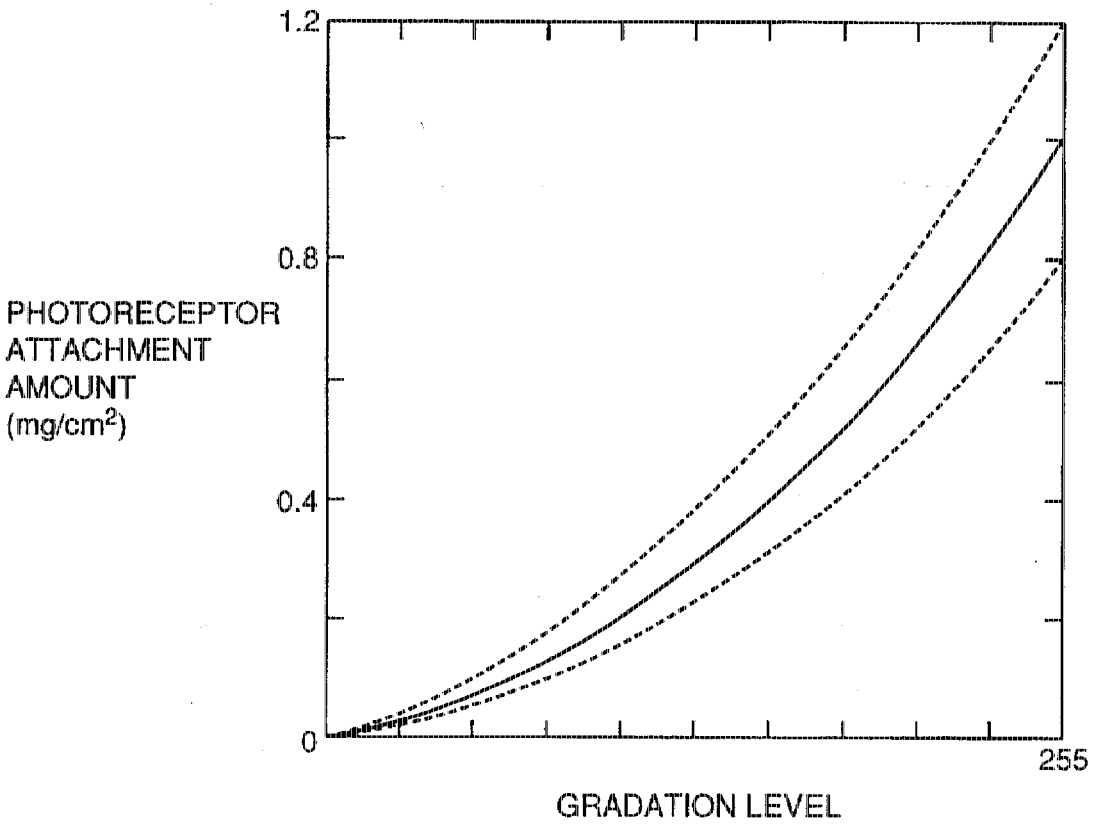
FIG. 9 is a graph showing the gradation level of an image and the amount of toner attachment onto a photoreceptor.

FIG. 9 is a graph showing the relationship of the actual gradation level of an image and the amount of toner attachment onto photoreceptor drum 21. In practice, the amount of toner attachment varies in at developing device at a range indicated by the dotted line even if the gradation level is the same. This is because develop efficiency η changes according to variation in the environment, copy mode, and durability degree as described in the first embodiment. Although AIDC is carried out in the image formation apparatus of the second embodiment to eliminate such problems, it is difficult to control the amount of toner attachment so as not to deviate from the solid line in FIG. 8. The amount of toner consumption is also affected by scattered toner irrespective of image formation.

In order to improve the estimation accuracy of the toner density by a dot counter in the image formation apparatus of the second embodiment, the supply amount of black toner is determined on the basis of the relationship between the amount of toner consumption and the amount of toner supply of cyan developing device 41C. This will be described in detail hereinafter.

As mentioned before, cyan developing device 41C has its toner density controlled under optical ATDC that does not easily generate detection error even if the environment, copy mode, durability, and the like vary. Therefore, it is possible to obtain the relationship between the amount of toner consumption estimated by the dot counter and the actual toner supply amount from cyan developing device 41C. This relationship is illustrated as in the graph of FIG. 10.

Figure 10:
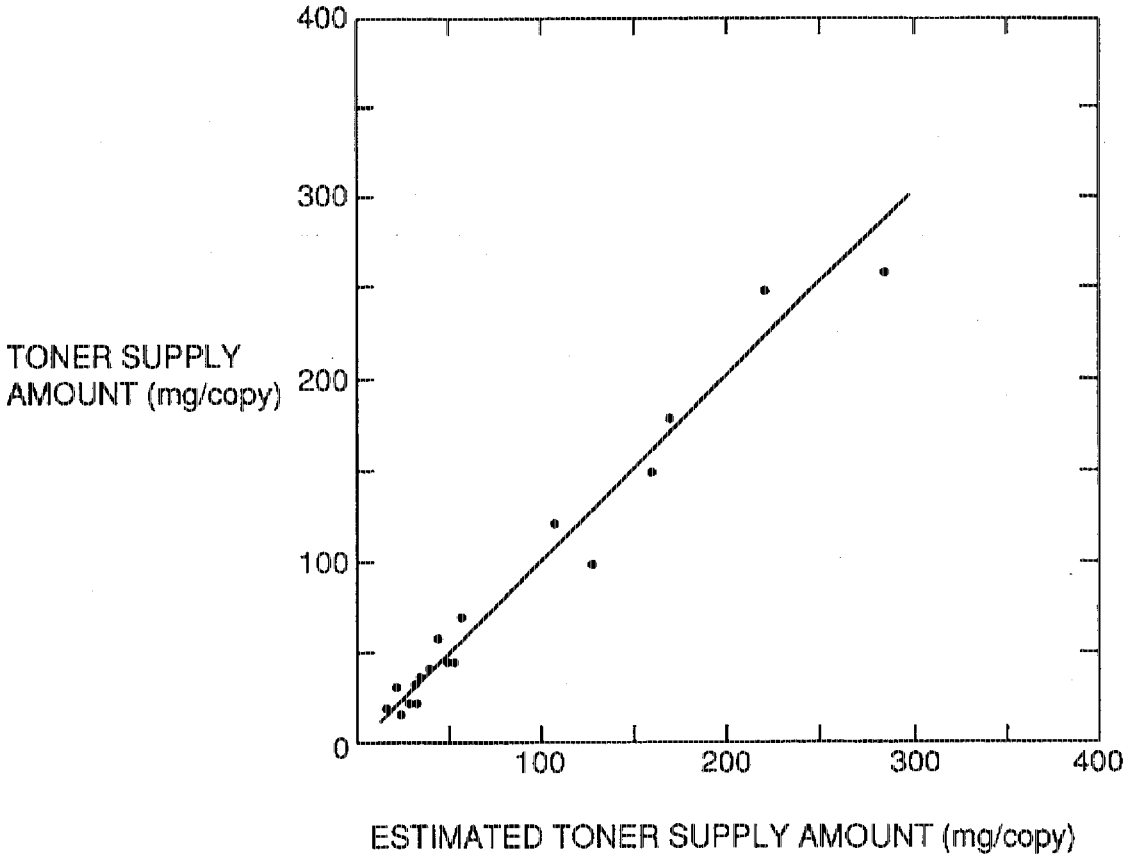
FIG. 10 is a graph showing the estimated amount of toner consumption and the actual toner supply amount.

Taking into account the fact that the relationship between image data and the amount of toner attachment is varied sequentially in the second embodiment, the average for every ten copies is calculated to obtain one point on the graph of FIG. 10, and the graph of FIG. 10 is approximated linearly from the data of the latest twenty points.

The environment, the number of copies, and the usage status of cyan developing device 41C and black developing device 41Bk are substantially the same. Therefore, it is presumed that the relationship between the amount of toner consumption estimated by the dot counter and the actual toner supply amount is substantially the same between cyan developing device 41C and black developing device 41Bk. Based on this presumption, the amount of toner consumption is estimated by a conventional dot counter method to determine the toner supply amount from the graph of FIG. 10 according to the estimated amount of toner consumption, as to the density control of the black toner in the second embodiment.

The specific toner density control carried out by CPU 201 of the image formation apparatus of the second embodiment will be described hereinafter with reference to the flow charts of FIGS. 11–13.

Figure 11:
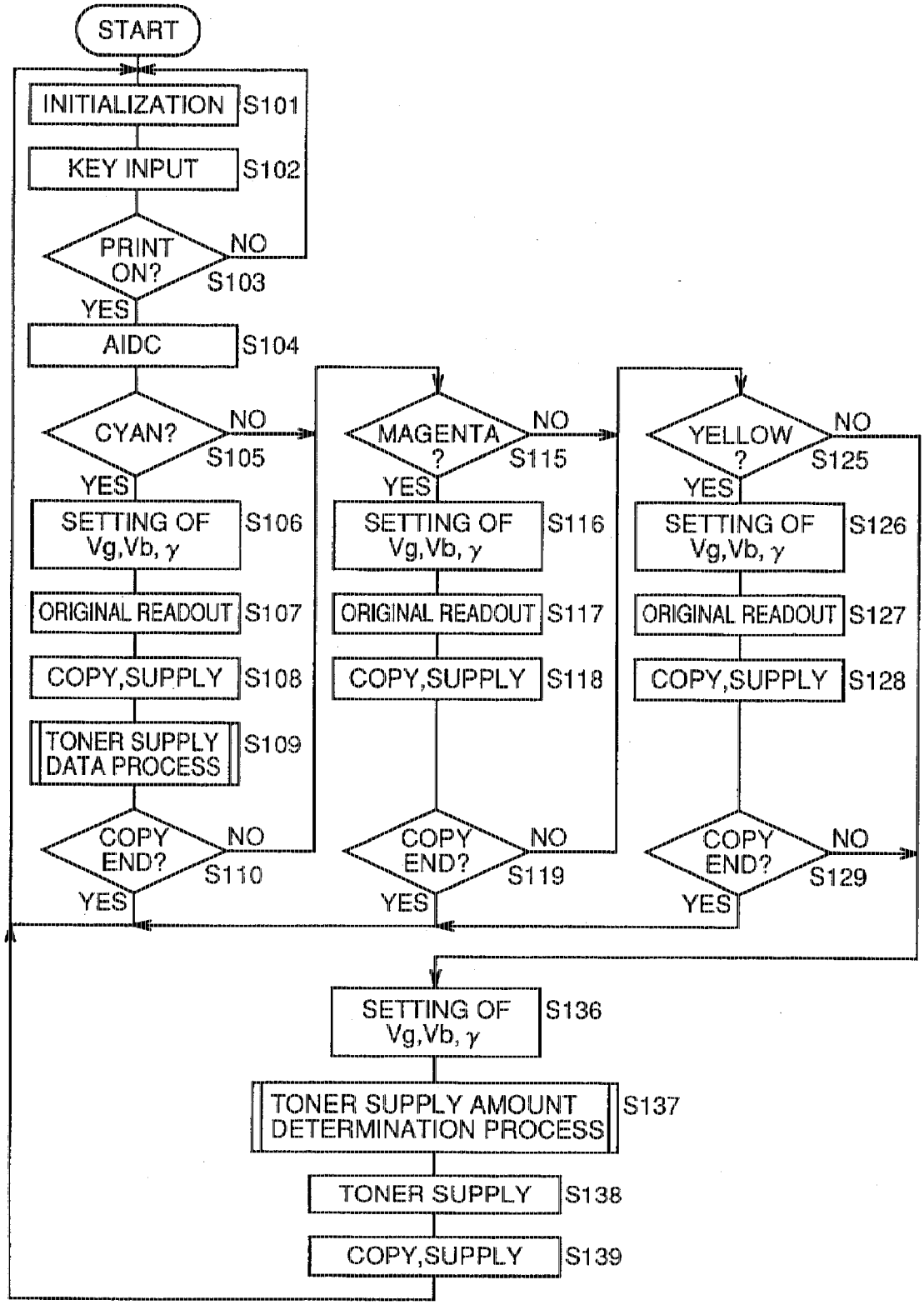
FIG. 11 is a flow chart of a toner density control of the second embodiment.

FIG. 11 shows the toner supply control routine of the copier of the second embodiment. When the power of the copier is turned on, initialization is carried out (S101). Then, key input is accepted (S102). The number of copies and the copy mode are set by the operator in this key input operation.

Then, determination is made whether the print switch is turned on or not (S103). If the print switch is not turned on, the control returns to the key input acceptance (S102). If the print switch is turned on, measurement of a test toner image by the AIDC sensor is carried out (S104). In the measurement of a test toner image by the AIDC sensor, a test toner image is formed on a photoreceptor according to a predetermined develop potential difference ΔV, whereby develop efficiency η of each developer is obtained.

Next, determination is made whether the operation is a copy of cyan (S105). If NO, the control proceeds to determination of a magenta copy (S115). If a copy of cyan is carried out, grid voltage Vg, develop bias Vb, and γ correction table of Table 1 stored in data ROM 203 described in the first embodiment are Selected and set (S106) according to develop efficiency η of the cyan developer obtained at S104. Then, the original is read out (S107), and cyan image data is generated by image data conversion unit 205. Image formation by the well known electrophotography is carried out. At the same time, the toner density is adjusted according to optical ATDC for cyan developing device 41C (S108). Then, the image data obtained at S107 and data of the actual amount of supplied toner at S108 by optical ATDC are processed (S109). Details of this process will be described afterwards. Then, determination is made whether the copy operation is completed or not (S110). If NO, the control proceeds to determination of a copy of magenta (S115). When the copy operation is completed, the control returns to the key input (S102).

Then, the copy operation of magenta (S115~S119), and the copy operation of yellow (S125~S129) are sequentially carried out in a manner identical to the copy operation of cyan excluding the process of S109.

If the copy and adjustment of the toner density of yellow is completed, or if copy of yellow is not carried out, the control proceeds to the black copy operation. First, grid voltage Vg, develop bias Vb and γ correction table of Table 1 stored in data ROM 203 are selected and set (S136) according to develop efficiency η of the black developer obtained at S104. Then, the original is read out (S137), and image data of black is generated by image data converter unit 205. According to this signal, the black toner supply amount calculation and correction process (S138) is carried out. The contents of this process will be described afterwards. Then, the well known electrophotographic image formation is carried out (S139). When the copy operation is completed, the control returns to key input acceptance (S102).

Figure 12:
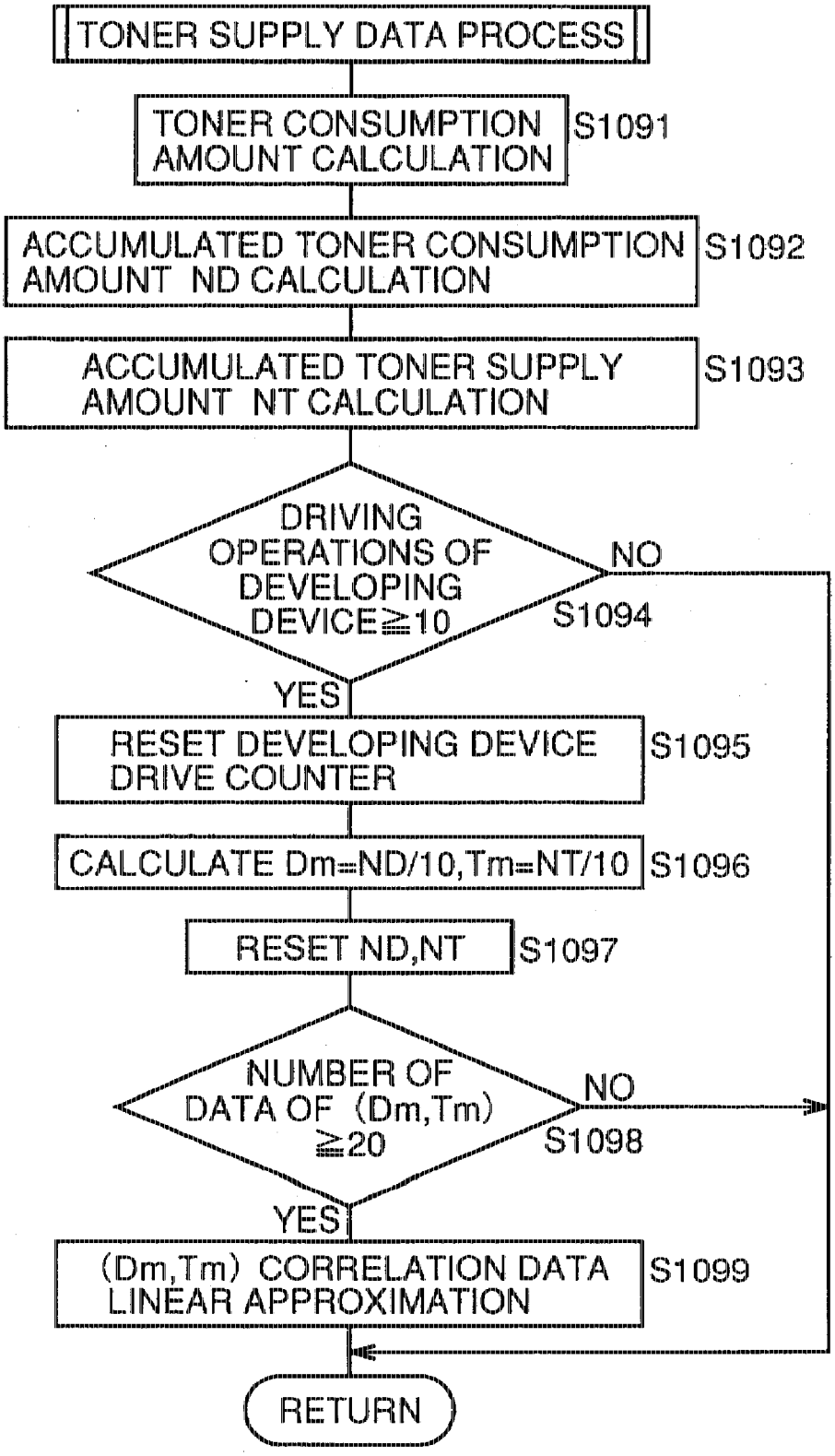
FIG. 12 is a flow chart showing data processing of the second embodiment.

FIG. 12 is a flow chart showing the procedure of the toner supply data process carried out in S109.

At every one copy operation of a cyan image, i.e. at every one drive of cyan developing device 41C, the estimated value D of the amount of cyan toner consumption of the current copy operation is calculated (S1091) by CPU 201 according to the number of pixels counted by dot counter unit 301 on the basis of the image data generated at the original readout step of S107. This estimated value D is added to the accumulated amount of toner consumption up to the prior copy operation to obtain the estimated amount ND of the accumulated amount of toner consumption up to the current copy operation. This estimated amount ND is stored in RAM 204 (S1092). Next, the actual amount of supplied cyan toner at S108 is added to the accumulated toner supply amount up to the prior copy operation to obtain the accumulated amount of toner supply NT up to the current copy operation. This supplied amount NT is stored in RAM 204 (S1093). Then, determination is made whether the number of drive operations of cyan developing device 41C counted by the developing device drive counter has reached the value of 10 prestored in data ROM 203 (S1094). If the count has not yet arrived at 10, the control returns. If the value has reached 20, the developing device drive counter is reset (S1095). The estimated amount of accumulated toner consumption ND and the accumulated amount of toner consumption NT is converted into average values Dm and Tm, respectively, per one sheet. These average values are stored in RAM 204 (S1096). Then, the estimated amount of accumulated toner consumption ND and the amount of toner consumption NT are reset (S1097). Next, determination is made whether the number of data of the estimated amount of toner consumption Dm and the amount of toner consumption Tm per one sheet has arrived at the value of 20 (S1098). If the value has not yet reached 20, the control returns. Otherwise, the latest 20 sets of Dm and Tm data are read out from the RAM to calculate a linear approximation correlation expression to produce a graph of estimated amount of toner consumption and actual amount of toner supply (FIG. 10) as a table, which then is stored in RAM 204 (S1099). Then, the control returns. The value of 10 as the data value to be averaged and 20 set as the number of data for linear approximation may be modified appropriately.

Figure 13:
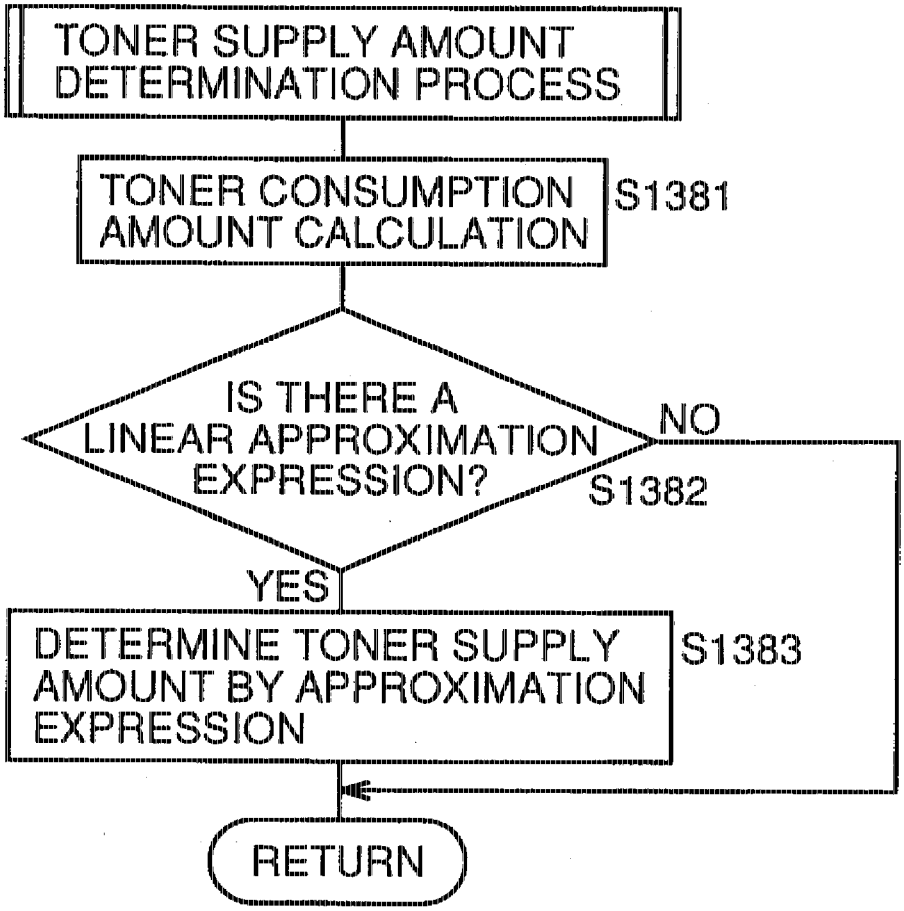
FIG. 13 is a flow chart showing the process of calculation and correction of the toner supply amount of the second embodiment.

FIG. 13 is a flow chart showing the procedure of the toner supply amount calculation and correction process which is carried out in S138.

At every one drive of black developing device 41Bk, the estimated value D' of the amount of black toner consumption up to the current copy operation is count by dot counter unit according to image data generated by reading out the original at S137. This estimated value D' is added to the accumulated amount of toner consumption up to the prior copy operation to obtain the estimated amount ND' of accumulated toner consumption up to the current copy operation. The value of ND' is stored in RAM 204 (S1381). Then, determination is made whether there is a table of the estimated amount of toner consumption calculated and the actual amount of toner supply produced at S1099 (S1382). If such a table is not present, the control returns. If there is a table, the amount of black toner supply with respect to the estimated value D' of black toner consumption according to the approximation expression is calculated (S1383).

Thus, in the second embodiment, the black toner supply amount is calculated from the relationship between the estimated amount of toner consumption and the actual supplied amount of cyan toner, so as to maintain appropriately the toner density in black developing device 41Bk.

Although the toner supply amount of black developing device 41Bk is determined according to the relationship between the amount of toner consumption and the amount of toner supply of cyan developing device 41C, the toner supply amount of black developing device 41Bk can be determined with magenta developing device 41M or yellow developing device 41Y according to a process similar to that of cyan developing device 41C. Alternatively, an optical ATDC sensor can be provided at any one of the cyan, magenta, and yellow developing devices, and have the toner density of the other developing devices controlled by a dot counter.

Third Embodiment

[Structure and Control of Copier]

The structure of a full color copier according to a third embodiment of the present invention is substantially similar to that of the first embodiment. Only the differing portion will be described afterwards, and description of the same portions will not be repeated.

Figure 14:
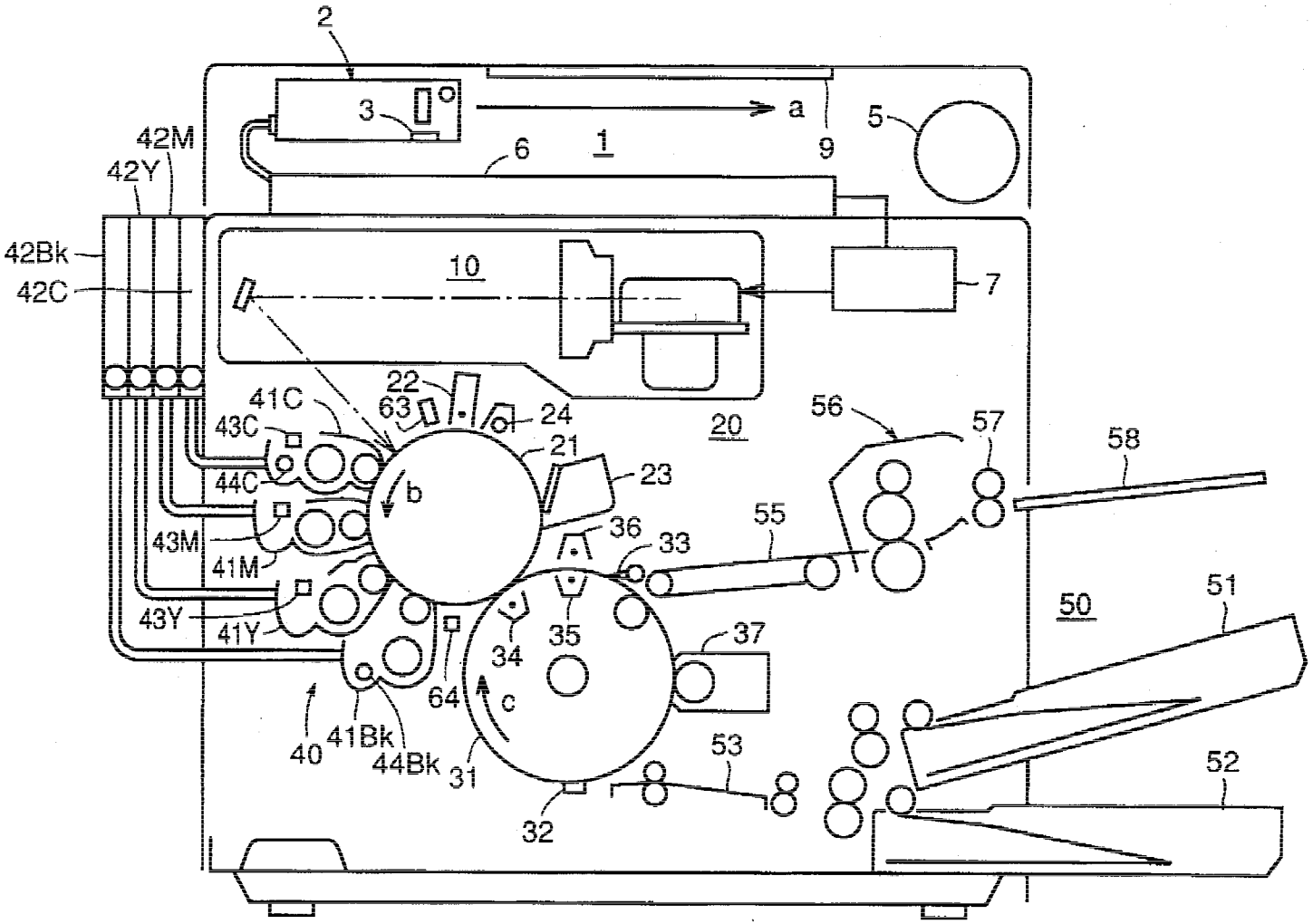
FIG. 14 is a schematic diagram of a structure of a full color copier according to a third embodiment of the present invention.
Figure 15:
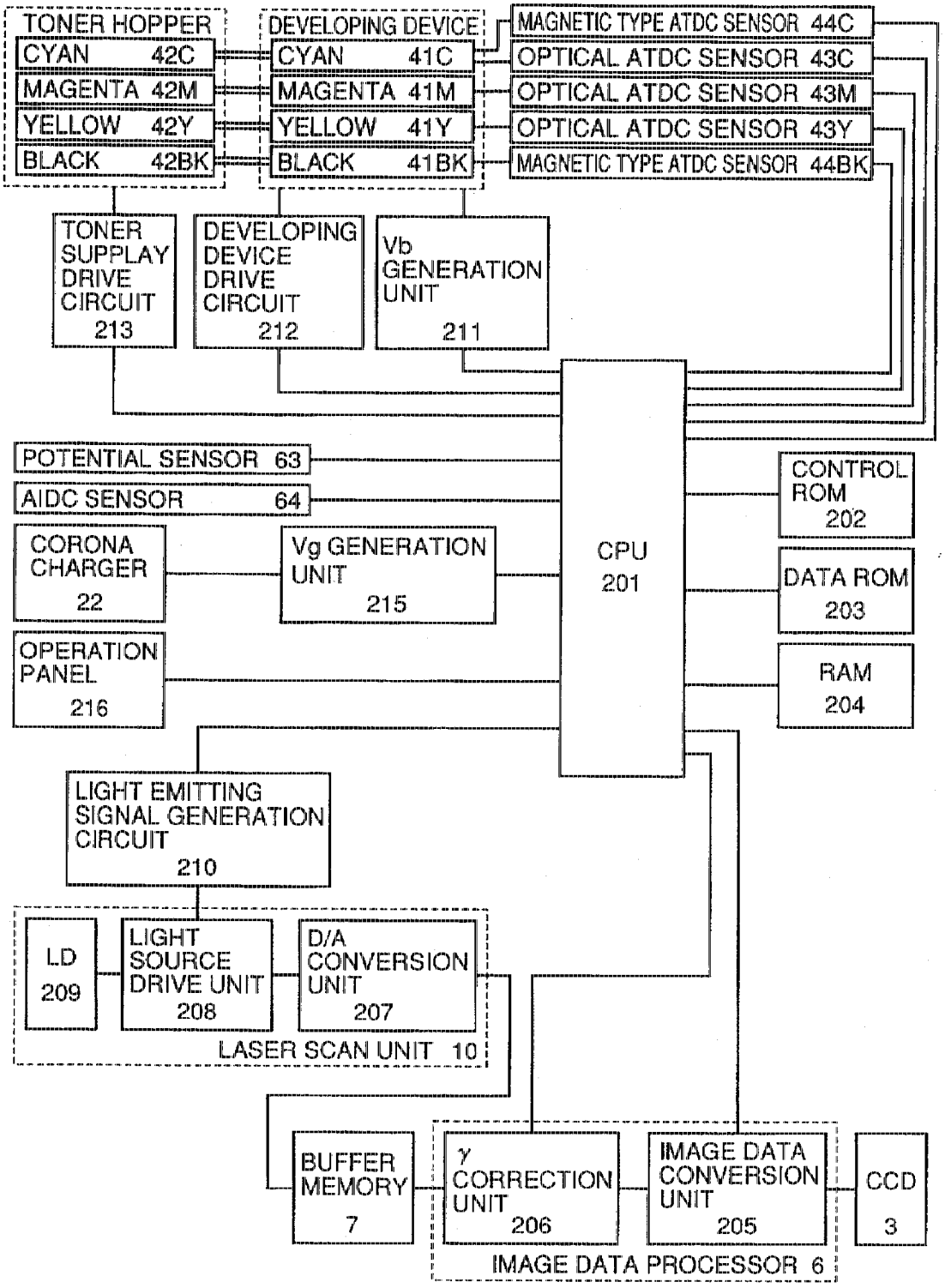
FIG. 15 is a block diagram of a control circuit of the full color copier of the third embodiment.

Referring to FIG. 14, a full color copier of the third embodiment has magnetic type sensors 44C and 44Bk attached in cyan developing device 41C and black developing device 41Bk, respectively. In the block diagram of FIG. 15, the outputs from magnetic type ATDC sensors 44C and 44Bk are provided to CPU 201.

[Toner Density Control]

Among the four developing devices provided in the third embodiment, each of cyan, magenta, and yellow developing devices 41C, 41M, 41Y has the toner density controlled by an optical ATDC provided in the developing device, similar to the first embodiment. For black developing device 41Bk, output error of magnetic type ATDC sensor 44Bk is calculated from the output of optical ATDC sensor 43C provided in cyan developing device 41C. Correction is applied to magnetic type ATDC sensor 44Bk according to the calculated result to control the toner density. Control of the toner density of black developing device 41Bk will be described hereinafter.

Figure 16:
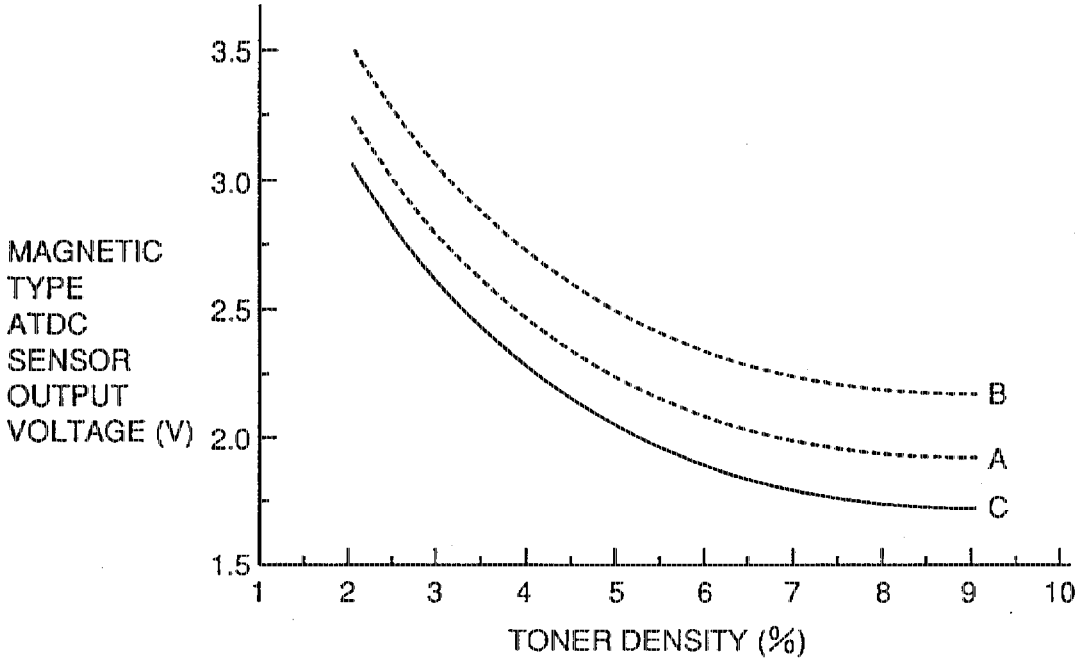
FIG. 16 is a graph showing the output characteristic with respect to absolute humidity of a magnetic type ATDC sensor of the third embodiment.

FIG. 16 is a graph showing the toner density of a developer using a magnetic type ATDC sensor, wherein the output voltage of the magnetic type ATDC sensor is plotted along the ordinate and the toner density is plotted along the abscissa. Curves A, B, and C of FIG. 16 show the cases of a standard environment (6 $g/m^3$), a high humidity environment (15 $g/m^3$) and a low humidity environment (3 $g/m^3$), respectively.

It is appreciated from FIG. 16 that the output value of the magnetic type ATDC sensor greatly depends on the absolute humidity. This is because the post-process agent with silica and the like as the main component that is added to improve the fluidity of the developer is hygroscopic. When the amount of vapor in the air increases to result in a higher absolute humidity value, the post-process agent expands to result in change in volume. In principle, the magnetic type ATDC sensor detects variation in the magnetic flux density per unit volume in the developer. Therefore, variation in volume of the post-process agent will directly result in change in the flux density per unit volume of the developer. The magnetic type ATDC sensor will erroneously detect variation in the toner density even if it does not actually change. Toner supplement based on only the output value of the magnetic type ATDC sensor will prevent the toner density in the developing device from being maintained appropriately if there is variation in the absolute humidity.

Figure 17:
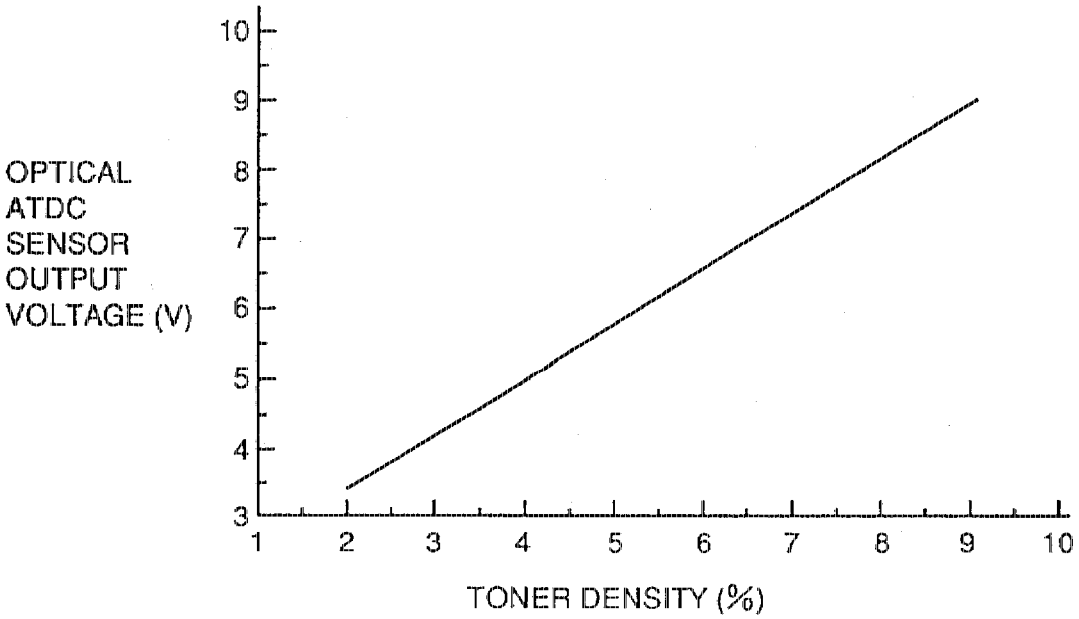
FIG. 17 is a graph showing the output characteristic of a optical ATDC sensor of the third embodiment.

FIG. 17 is a graph showing detected toner density of the same developer used in FIG. 16 according to a optical ATDC sensor, wherein the output voltage is plotted along the ordinate and the toner density is plotted along the abscissa. In principle, a optical ATDC sensor detects the toner density by directing a light beam differing in reflectance between magnetic carrier and toner to a developer to detect the intensity of the reflected light. Therefore, the output value thereof is not easily affected by change in the bulk density of the developer. This means that the output voltage of the optical ATDC sensor is immune to variation in the absolute humidity. The relationship between the output voltage and the toner density does not change in any of the cases of a standard environment, a high humidity environment, and a low humidity environment.

Figure 18:
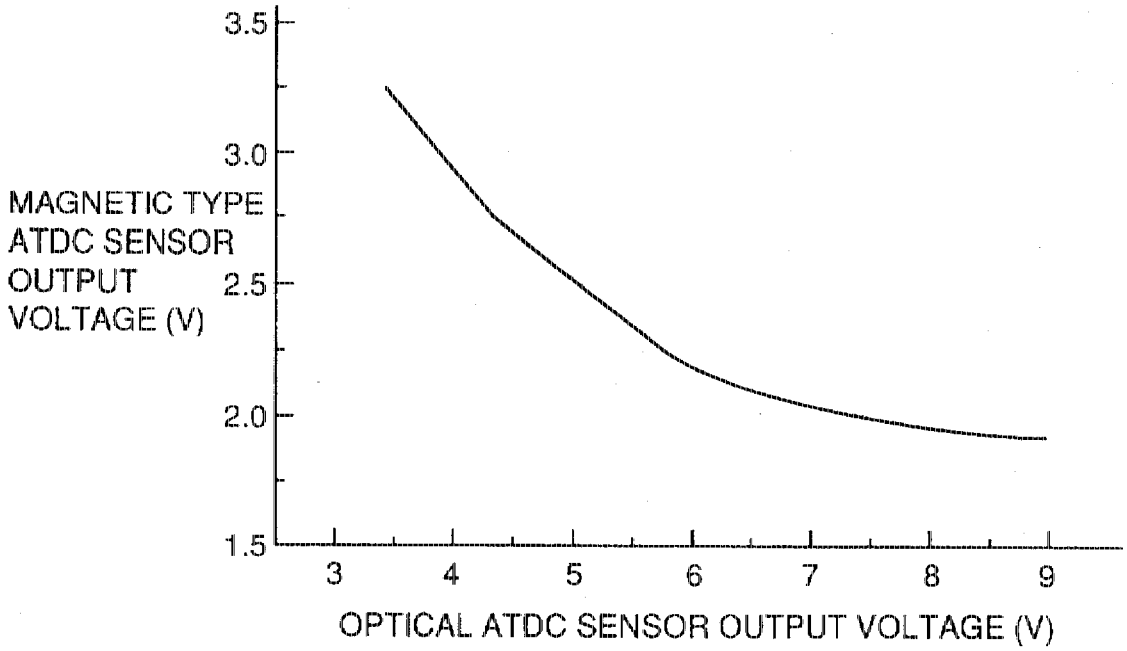
FIG. 18 is a graph showing the relationship in output voltage between the magnetic type ATDC sensor and the optical ATDC sensor of the third embodiment.

FIG. 18 shows the relationship in the output voltage between a optical ATDC sensor and a magnetic type ATDC sensor with respect to the same developer in a standard state. When the magnetic type ATDC sensor detects the toner density accurately, the output voltage relationship between the magnetic type ATDC sensor and the optical ATDC sensor is represented by the curve of FIG. 18. However, variation in the output voltage of the magnetic type ATDC sensor due to the influence of environment and the like will cause the output voltage relationship of the two sensors to deviate from the curve of FIG. 18.

Detection error in the magnetic type ATDC sensor with respect to environment and the like can be predicted according to this relationship. By storing the graph of FIG. 18 in a table format in a ROM, detecting the toner density of the same developer with a optical ATDC sensor and a magnetic type ATDC sensor, and comparing the relationship of the output values of the sensors with the data in the data, detection error of the magnetic type ATDC sensor can be predicted and quantified.

The toner density of black developing device 41Bk is controlled according to this presumption in the third embodiment.

The toner densities of cyan developing device 41C and black developing device 41Bk are detected by optical ATDC sensor 40C and magnetic type ATDC sensor 44C, and magnetic type ATDC sensor 44Bk, respectively. The relationship of the output values of a optical ATDC sensor and a magnetic type ATDC sensor measured previously, and the relationship of the toner density to the output voltage of magnetic type ATDC sensor are stored in table formats in data ROM 203 connected to CPU 201.

CPU 201 predicts the output error of the magnetic type ATDC sensor from the relationship of the output voltage of optical ATDC sensor 40C provided in cyan developing device 41C and the output voltage stored in data ROM 203 of the magnetic type ATDC sensor to the optical ATDC sensor.

According to the assumption that a similar output error occurs in magnetic type ATDC sensor 44Bk provided in black developing device 41Bk, CPU 201 applies a correction value corresponding to the presumed output error of the magnetic type ATDC sensor to the output value of magnetic type ATDC sensor 44Bk. The result is taken as the output value of magnetic type ATDC sensor 44Bk. This output value is compared with the proper toner density stored in data ROM 203. If the detected toner density is lower than the proper toner density stored in data ROM 203, a drive control signal is provided to toner supply drive device 212. If the detected toner density is higher than the proper toner density, a control signal is not output. Toner supply drive device 212 responds to the received drive control signal to supply toner to developing device 41Bk. According to the above-described procedure, the toner density of developing device 41Bk is maintained appropriately.

As to the above-described presumption of the toner density of developing device 41Bk, specific numerics will be shown hereinafter referring to FIGS. 19 and 20.

Figure 19:
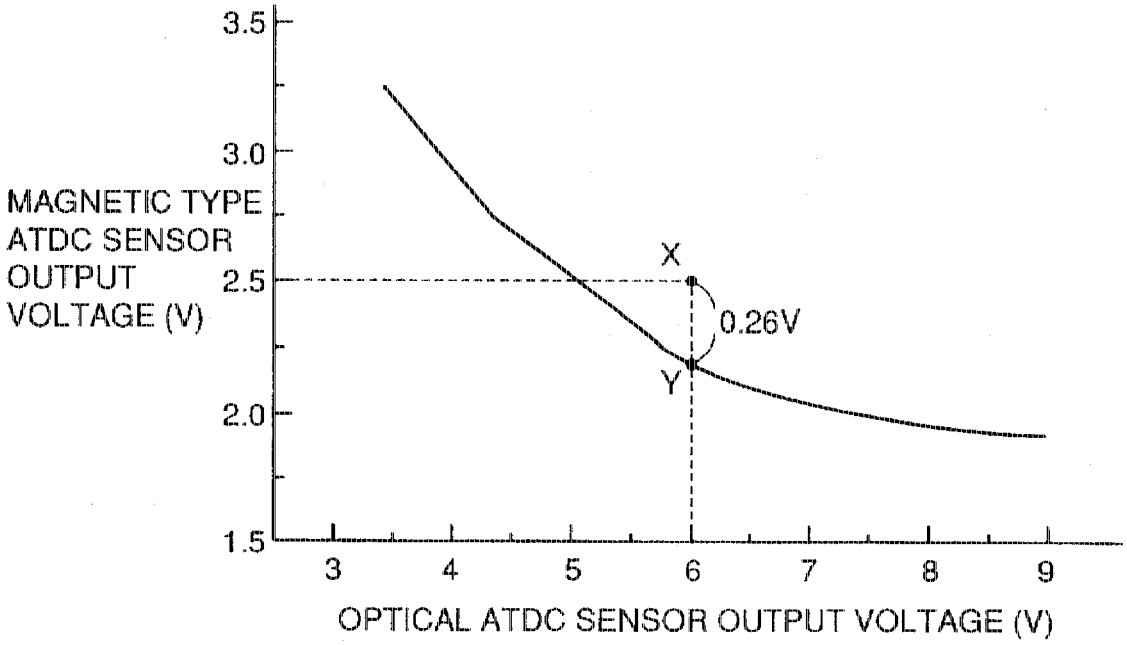
FIG. 19 is a graph for describing numerical examples from the relationship in output voltage between the magnetic type ATDC sensor and the optical ATDC sensor of the third embodiment.

Similar to the graph of FIG. 18, the curve in FIG. 19 shows the relationship of output voltages between a optical ATDC sensor and a magnetic type ATDC sensor measuring the toner density of the same developer at a standard state. It is now assumed that the output voltage of optical ATDC sensor 43C of cyan developing device 41C is 6.0V, and the output voltage of magnetic type ATDC sensor 44C of cyan developing device 41C is 2.50V (corresponding to point X on graph). In this case, it is presumed that the output of magnetic type ATDC sensor 44C has an error of 0.26V with respect to the proper value (corresponding to point Y on graph) of the output of the magnetic type ATDC sensor to the optical ATDC sensor on the graph.

Figure 20:
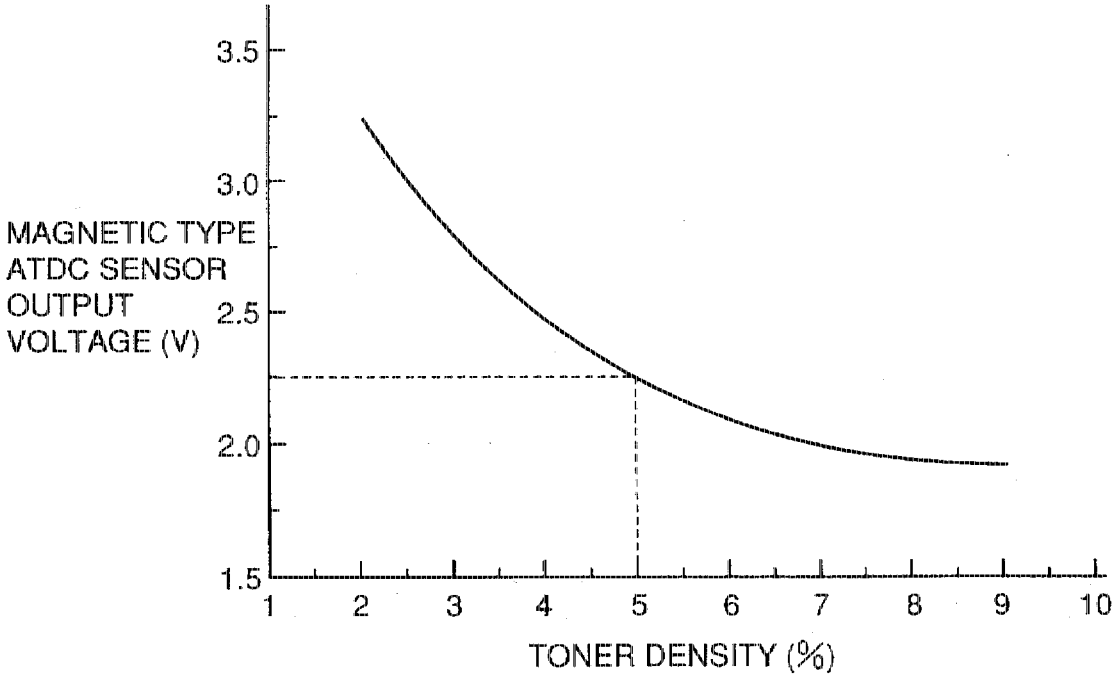
FIG. 20 is a graph for describing the method of estimating the toner density of the numeric examples from the output voltage of the magnetic type ATDC sensor of the third embodiment.

FIG. 20 shows the relationship between the output value and toner density of the magnetic type ATDC sensor in a standard state. Referring to FIG. 20, conversion of the corrected output voltage 2.4V (2.50V–0.26V) of magnetic type ATDC sensor 44Bk into a toner density results in 5.2%. Therefore, it is presumed that the toner density of black developing device 41Bk is 5.2% corresponding to 2.24V.

Figure 21:
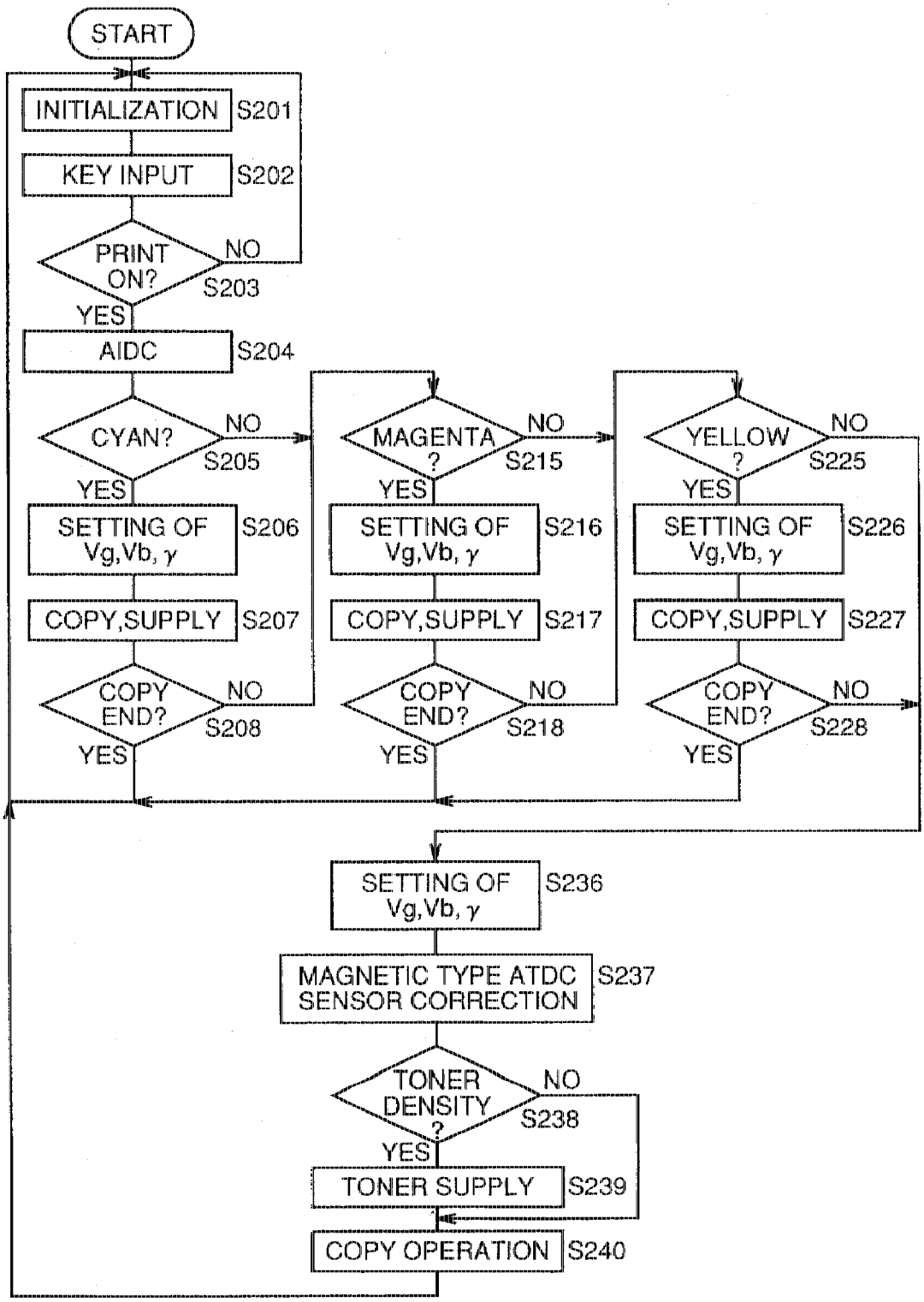
FIG. 21 is a flow chart of a toner density control of the third embodiment.

The toner density control will be described specifically hereinafter with reference to the flow chart of FIG. 21.

When the power of the copier is turned on, initialization is carried out (S201). Key input is accepted (S202). The number of copies, the copy mode, and the like are set by the operator via key input.

Next, determination is made whether the print switch is turned on or not (S203). If the print switch is not turned on, control returns to key input acceptance (S202). If the print switch is turned on, measurement of a test toner image by an AIDC sensor is carried out (S204). In the measurement of the test toner image by the AIDC sensor, a test toner image is formed on the photoreceptor by the predetermined develop potential difference $\Delta V$, whereby the develop efficiency $\eta$ of cyan, magenta, yellow, and black is obtained.

Then, determination is made whether the operation is a cyan copy (S205). If cyan copy is not carried out, the control proceeds to the determination of a magenta copy (S215). If a cyan copy is carried out, grid voltage Vg, develop bias Vb, and the $\gamma$ correction table of Table 1 stored in data ROM 203 are selected and set (S206) according to the develop efficiency $\eta$ of the cyan developer obtained at S204. Then, image formation according to the well known electrophotography is carried out. At the same time, the toner density of cyan developing device 41C is controlled under ATDC by optical ATDC sensor 43C (S207). Determination is made whether the copy and adjustment operation of the toner density is to be continued or not (S208). If the operation is to be continued, the control proceeds to the determination of a magenta copy (S215). When the operation is to be ended, control returns to key input acceptance (S202).

Next, a copy operation of magenta (S215~218 and a copy operation of yellow (S225~S228) are carried out likewise the cyan copy.

When the copy and toner density adjustment operation of yellow is completed, or when a yellow copy is not carried out, the control proceeds to the copy of black. Grid voltage Vg, develop bias Vb, and the $\gamma$ correction table of Table 1 stored in data ROM 203 are selected and set (S236) according to develop efficiency $\eta$ of the black developer obtained at S204. Then, the output of magnetic type ATDC sensor 44Bk of black developing device 41Bk is corrected according to the data in data ROM 203, and a value converted into toner density is obtained (S237). Next, the calculated toner density of black developing device 41Bk is compared with a predetermined proper toner density (S238). If the calculated toner density is greater than the predetermined proper toner density, determination is made that the toner density is high, so that toner supply is not carried out. If the calculated toner density is smaller, determination is made that the toner density is low, and toner supply is carried out (S239). At completion of the above-described operations, control returns to key input acceptance (S202).

Thus, black developing device 41Bk has the black toner density set according to the relationship between optical ATDC sensor 43C and magnetic type ATDC sensor 44C of cyan developing device 41C of which the toner density is controlled appropriately by an optical ATDC. Thus, the proper toner supply amount is determined also by magnetic type ATDC sensor 43Bk.

Although two sensors are attached to cyan developing device 41C in the third embodiment, a optical ATDC sensor and a magnetic type ATDC sensor may be provided to magenta developing device 41M and yellow developing device 41Y to obtain the tone density of black developing device 41Bk according to the output values thereof. Alternatively, a optical ATDC sensor can be provided in any one of cyan, magenta, and yellow developing devices, and have the toner density of all the other developing devices controlled by a magnetic ATDC likewise black developing device 41Bk described in the third embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image formation apparatus including a plurality of developing devices developing an electrostatic latent image formed on a photoreceptor with a dual component developer including toner and magnetic carrier, said image formation apparatus comprising:

a first developing device incorporating a first developer having a spectral reflectance of toner and magnetic carrier not analogous to each other, a second developing device incorporating a second developer having a spectral reflectance of toner and magnetic carrier analogous to each other, toner density detection means provided at said first developing device to direct light to said first developer for detecting toner density of said first developing device according to intensity of reflected light of the directed light, first toner supply means for supplying toner to said first developing device according to the toner density detected by said toner density detection means, parameter detection means for detecting a parameter altered corresponding to variation in the toner density of said first and second developing devices, toner supply amount determination means for determining an amount of toner supply of said second developing device according to parameters of said first and second developing device detected by said parameter detection means, and second toner supply means for supplying toner to said second developing device according to the toner supply amount determined by said toner supply amount determination means.

2. The image formation apparatus according to claim 1, wherein said first developer comprises black toner including carbon black.

3. The image formation apparatus according to claim 1, wherein said second developer comprises color toner.

4. An image formation apparatus including a plurality of developing devices developing an electrostatic latent image formed on a photoreceptor with dual component developer including toner and magnetic carrier, said image formation apparatus comprising:

a first developing device incorporating a first developer having a spectral reflectance of toner and magnetic carrier not analogous to each other, a second developing device incorporating a second developer having a spectral reflectance of the toner and the magnetic carrier analogous to each other, toner density detection means provided at said first developing device to direct light to said first developer for detecting a toner density of said first developing device according to intensity of reflected light out of the directed light, first toner supply means for supplying toner to said first developing device according to the toner density detected by said toner density detection means, develop efficiency calculation means to form a reference toner image on said photoreceptor with said first and second developers under a predetermined image forming condition, and measuring an image density of said reference toner image for calculating a develop efficiency of said first and second developing devices according to said measured image density, toner supply amount determination means for determining an amount of toner supply of said second developing device according to said develop efficiency of said first and second developing devices calculated by said develop efficiency calculation means, and second toner supply means for supplying toner to said second developing device according to the toner supply amount determined by said toner supply amount determination means.

5. The image formation apparatus according to claim 4, wherein said first developer comprises black toner including carbon black.

6. The image formation apparatus according to claim 4, wherein said second developer comprises color toner.

7. The image formation apparatus according to claim 4, wherein an image forming conditions with respect to the developers incorporated in said first and second developing devices is controlled according to the develop efficiency calculated by said develop efficiency calculation means.

8. The image formation apparatus according to claim 4, wherein said toner supply amount determination means comprises memory means in which a relationship of develop efficiency values between said first and second developers is prestored.

9. An image formation apparatus for forming an electrostatic latent image on a photoreceptor according to a digital image signal, and including a plurality of developing devices for developing said electrostatic latent image with dual component developer including toner and magnetic carrier, said image formation apparatus comprising:

a first developing device incorporating a first developer having a spectral reflectance of toner and magnetic carrier not analogous to each other, a second developing device incorporating a second developer having a spectral reflectance of toner and magnetic carrier analogous to each other, toner density detection means provided at said first developing device to direct light to said first developer for detecting a toner density of said first developing device according to intensity of reflected light out of the directed light, first toner supply means for supplying toner to said first developing device according to the toner density detected by said toner density detection means, toner consumption amount estimation means for estimating an amount of toner consumption of said first and second developing devices according to density information included in said digital image signal, tone supply amount determination means for determining a toner supply amount of said second developing device according to the toner consumption amount of said first and second developing devices estimated by said toner consumption amount estimation means, and the toner supply amount supplied to said first developing device according to said first toner supply means, and second toner supply means for supplying toner to said second developing device according to the toner supply amount determined by said toner supply amount determination means.

10. The image formation apparatus according to claim 9, wherein said first developer comprises black toner including carbon black.

11. The image formation apparatus according to claim 9, wherein said second developer comprises color toner.

12. The image formation apparatus according to claim 9, wherein said toner supply amount determination means comprises memory means for storing a relationship between the toner consumption amount of said first developing device estimated by said toner consumption amount estimation means, and the toner supply amount supplied to said first developing device by said first toner supply means.

13. The image formation apparatus according to claim 12, wherein the relationship between the toner consumption amount of said first developing device and the toner supply amount stored in said memory means is modified at every predetermined number of image formations.

14. An image formation apparatus including a plurality of developing devices developing an electrostatic latent image formed on a photoreceptor with dual component developer including toner and magnetic carrier, said image formation apparatus comprising:

a first developing device incorporating a first developer having a spectral reflectance of toner and magnetic carrier not analogous to each other, a second developing device incorporating a second developer having a spectral reflectance of toner and magnetic carrier analogous to each other, toner density detection means provided at said first developing device to direct light to said first developer for detecting a toner density of said first developing device according to intensity of reflected light out of the directed light, first toner supply means for supplying toner to said first developing device according to the toner density detected by said toner density detection means, a first magnetic type sensor provided at said first developing device for detecting variation in magnetic permeability of said first developer, a second magnetic type sensor provided at said second developing device for detecting variation in magnetic permeability of said second developer, toner supply amount determination means for determining a toner supply amount of said second developing device according to a change of the magnetic permeability of said first and second developers detected by said first and second magnetic type sensors, and the toner density of said first developing device detected by said toner density detection means, and second toner supply means for supplying toner to said second developing device according to the toner supply amount determined by said toner supply amount determination means.

15. The image formation apparatus according to claim 14, wherein said first developer comprises black toner including carbon black.

16. The image formation apparatus according to claim 14, wherein said second developer comprises color toner.

17. The image formation apparatus according to claim 14, wherein said toner supply amount determination means comprises memory means for storing a relationship between an output of said toner density detection means and an output of said first magnetic type sensor.

18. An image forming apparatus comprising:

a first developing device incorporating a first developer;

a second developing device incorporating a second developer;

toner density detection means for directly detecting a toner density of said first developer of said first developing device;

first toner supply means for supplying toner to said first developing device according to the toner density detected by said toner density detection means;

parameter detection means for detecting a parameter altered corresponding to variations in the toner density of said first and second developing devices;

toner supply amount determination means for determining an amount of toner supply of said second developing device according to the parameters of said first and second developing devices detected by said parameter detection means; and second toner supply means for supplying toner to said second developing device according to the toner supply amount determined by said toner supply amount determination means.

19. An image forming apparatus comprising:

a first developing device incorporating a first developer;

a second developing device incorporating a second developer;

toner density detection means for directly detecting a toner density of said first developer of said first developing device;

first toner supply means for supplying toner to said first developing device according to the toner density detected by said toner density detection means;

developing efficiency detection means to form a reference toner image with said first and second developers, and measuring an image density of the toner image for detecting a developing efficiency of said first and second developers;

toner supply amount determination means for determining an amount of toner supply of said second developing device according to the developing efficiency of said first and second developing devices detected by said developing efficiency detection means; and second toner supply means for supplying toner to said second developing device according to the toner supply amount determined by said toner supply amount determination means.

20. An image forming apparatus comprising:

a first developing device incorporating a first developer;

a second developing device incorporating a second developer;

toner density detection means for directly detecting toner density of said first developer of said first developing device;

first toner supply means for supplying toner to said first developing device according to the toner density detected by said toner density detection means;

toner consumption amount estimation means for estimating an amount of toner consumption of said first and second developing devices according to density information included in a digital image signal;

toner supply amount determination means for determining an amount of toner supply of said second developing device according to toner consumption amount of said first and second developing devices detected by said toner consumption amount estimating means; and second toner supply means for supplying toner to said second developing device according to the toner supply amount determined by said toner supply amount determination means.

21. An image forming apparatus comprising:

a first developing device incorporating a first developer;

a second developing device incorporating a second developer;

toner density detection means for directly detecting toner density of said first developer of said first developing device;

first toner supply means for supplying toner to said first developing device according to the toner density detected by said toner density detection means;

a first magnetic type sensor provided at said first developing device for detecting a toner density of said first developing device;

a second magnetic type sensor provided at said second developing device for detecting a toner density of said second developing device;

toner supply amount determination means for determining an amount of toner supply of said second developing device according to an information of the toner density detected by said toner density detecting means, the toner density detected by said first magnetic type sensor and the toner density detected by said second magnetic type sensor; and second toner supply means for supplying toner to said second developing device according to the toner supply amount determined by said toner supply amount determination means.

* * * * *